US010907914B2

(12) United States Patent
Al-Otaibi

(10) Patent No.: US 10,907,914 B2
(45) Date of Patent: Feb. 2, 2021

(54) AIR-COOLED HEAT EXCHANGER CLEANING AND TEMPERATURE CONTROL APPARATUS AND METHOD

(71) Applicant: Saudi Arabian Oil Company, Dhahran (SA)

(72) Inventor: Abdullah M. Al-Otaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 217 days.

(21) Appl. No.: 15/975,439

(22) Filed: May 9, 2018

(65) Prior Publication Data

US 2019/0346222 A1 Nov. 14, 2019

(51) Int. Cl.

| | |
|---|---|
| ***F28G 1/16*** | (2006.01) |
| ***B08B 3/02*** | (2006.01) |
| ***B08B 3/08*** | (2006.01) |
| ***F28G 9/00*** | (2006.01) |
| ***B08B 9/032*** | (2006.01) |
| ***F28G 1/12*** | (2006.01) |
| *F28D 1/053* | (2006.01) |

(52) U.S. Cl.

CPC ..... *F28G 1/166* (2013.01); *B08B 3/02* (2013.01); *B08B 3/08* (2013.01); *B08B 9/0323* (2013.01); *F28G 1/12* (2013.01); *F28G 9/00* (2013.01); *B08B 2203/0217* (2013.01); *F28D 1/05341* (2013.01)

(58) Field of Classification Search

CPC ..... B08B 3/02; B08B 3/08; B08B 2203/0258; F28G 1/166; F28G 1/12; F28G 9/00

See application file for complete search history.

(56) References Cited

U.S. PATENT DOCUMENTS 2,112,896 A 4/1938 Husband
3,806,040 A 4/1974 McCloy
(Continued)

FOREIGN PATENT DOCUMENTS

DE 9418733 U1 1/1995

OTHER PUBLICATIONS

International Search Report and Written Opinion dated Jul. 25, 2019 in counterpart International application PCT/US2019/030357 filed May 2, 2019.

*Primary Examiner* — Mikhail Kornakov
*Assistant Examiner* — Natasha N Campbell
(74) *Attorney, Agent, or Firm* — Abelman, Frayne & Schwab

(57) ABSTRACT

A system for the maintenance and operation of an air-cooled heat exchanger (ACHE) includes a plurality of spray tubes provided with spaced-apart nozzles permanently positioned between the finned heat exchange tubes and longitudinally aligned within the region of the finned-tube pitch. The system is operable in several modes, including cleaning where the flow of air is stopped and temperature-controlled pressurized water with an optional cleaning agent is discharged from the nozzles to dislodge dirt and debris from the finned surfaces while simultaneously cooling the hot process liquid. When extremes of ambient air temperatures preclude the forced air fans from achieving the target temperature range of the process liquid passing through the ACHE, refrigerated pressurized cooled water and compressed air in the form of a mist is discharged from the nozzles, or alternatively, pressurized heated air is discharged from the nozzles.

9 Claims, 15 Drawing Sheets

(56) References Cited

U.S. PATENT DOCUMENTS

| | | | |
|---|---|---|---|
| 3,980,120 | A | 9/1976 | Fawcett et al. |
| 4,424,769 | A | 1/1984 | Charamathieu et al. |
| 4,827,953 | A | 5/1989 | Lee |
| 4,982,959 | A | 1/1991 | Rudell et al. |
| 5,065,703 | A | 11/1991 | Lee |
| 5,330,579 | A | 7/1994 | Rushinh et al. |
| 5,411,043 | A | 5/1995 | Kamler |
| 5,672,123 | A | 9/1997 | Rudell et al. |
| RE38,542 | E | 7/2004 | Ashton et al. |
| 6,820,575 | B2 | 11/2004 | Ashton, III et al. |
| 7,013,953 | B2 | 3/2006 | Jung |
| 8,974,607 | B2 | 3/2015 | Al-Otaibi |
| 2009/0211612 | A1 | 8/2009 | Athanassiu et al. |
| 2014/0326280 | A1 | 11/2014 | Al-Otaibi |

AIR-COOLED HEAT EXCHANGER CLEANING AND TEMPERATURE CONTROL APPARATUS AND METHOD

FIELD OF THE INVENTION

This invention relates to the construction, maintenance and operation of air-cooled heat exchanger units for commercial and industrial use.

BACKGROUND OF THE ART

Air-cooled heat exchanger (ACHE) units are in widespread use in a wide variety of industries and geographical locations for treating process fluids, including liquids and gases. The hot process fluid to be cooled to a target temperature, or temperature range, flows through a bundle or array of finned tubes while the ambient cooling air flows across the outer surfaces to remove heat. The cooling air is propelled by fans in either a forced draft or induced draft configuration. Specially designed fins are attached to the outer surface of the tubes to create a large surface area for more effective cooling. The heat transfer rate is a function of the surface area of the fins and the velocity of the air flow, as well as the temperature differential. For convenience, the following description will refer to process liquids.

As shown in FIG. 1, the typical ACHE 10 of the prior art is constructed from an array 30 of finned air-cooled tubes 32 extending in fluid communication between opposing headers 12, 13. The finned tubes 32 are arranged horizontally in a plurality of vertically spaced rows 24A through 24D. The spacing of the finned tubes 32 defines parallel open regions between the rows 24 in the array 30 that extend between the opposing walls of the headers 12, 13. A hot process liquid is directed to, and passes from an inlet 20 into header 12 at one end through the upper rows of finned tubes 32, where it is air-cooled and collected in the outlet 22 at a lower temperature after transferring to the lower rows of tubes at the opposite header 13. For the purpose of the following description, the term "finned tube(s)" shall be understood to include the tube(s) on which the fins are mounted and the individual fins, as well as their unitary construction.

Problems associated with ACHE units in specific climates and environments include accumulation of dust on and between the heat exchange fins which reduces the efficiency of the heat exchange with the air passing through the unit; insufficient temperature differentials to achieve the desired cooling of the hot process liquid by heat exchange with the surrounding hot ambient air; and extremely cold environments, e.g., at night and/or seasonally, leading to more than the desired decrease in temperature of the process liquid which can result in an increase in viscosity or even the freezing of the process liquid in the tubes.

The simplest method used for cleaning the forced air ACHE that is uncovered at the top is to use a hose and apply a pressurized stream of water. This can be a time-consuming and laborious operation and the lower level and/or interior portions of the finned tube array can be difficult to reach via the water stream and they therefore are not thoroughly cleaned.

Failure to regularly and thoroughly clean the fins can result in the buildup of deposits requiring the application of chemical cleaning agents which have an associated high cost and may cause corrosion of the metal tubes and the fins.

Mechanical cleaning devices that include a bank of water jet nozzles mounted on a track system over the tube bundle can be employed, but only when the fans are located below the tubes. In addition to being expensive, the water jetting does not reach the tubes at the bottom of the bundle and may actually damage the fins in the upper row or rows of tubes due to the high pressure of the water jet. The supporting substructure and equipment located beneath the tubes may also be subject to corrosion damage from this type of washing.

A portable system for positioning a mechanism constructed as a water impermeable mat fitted with a plurality of spray nozzles is disclosed in U.S. Pat. No. 8,974,607. The apparatus can be inserted in an ACHE in which the tubes are in generally horizontal rows and the fins vertically separated from each other to provide an open horizontal zone between the rows. A second impermeable water and debris collection mat or sheet is positioned between a lower pair of adjacent rows or below the last row of finned tubes in order to recover the cleaning medium.

An apparatus is described in US 2014/0326280 for cleaning an ACHE that includes a number of spray strips mounted on manifolds and provided with fluid supply tubes and spray controllers to form a rigid rack that is permanently mounted or removably inserted between adjacent rows of heat exchange tubes in a diagonal configuration. Each of the spray controllers includes multiple spray nozzles to disperse the cleaning fluid between the finned tubes of the heat exchanger. The manifolds are inserted diagonally adjacent the ACHE header in an area where the heat exchange tubes have no fins.

Although suitable for cleaning ACHE units, the apparatus of the prior art is limited to that purpose. The problem addressed by the present disclosure is how to efficiently and continuously operate an ACHE to cool a hot process fluid to a temperature within a predetermined temperature range under varying climatic conditions of extreme heat and cold, and difficult environmental conditions where dust, dirt and sand are passed through the finned tubes by the forced draft or induced draft air flow.

As used in the description which follows, the term "external source" will be understood to refer to an auxiliary system and/or apparatus of a type that is known and commonly used in the field, but which does not form an integral part of the integrated system of the present disclosure. For convenience, the use of the term "target temperature" is to be understood to also include "target temperature range".

SUMMARY OF THE INVENTION

These problems and others are addressed by the method, apparatus and system of the present disclosure which includes the permanent installation of an integrated array of spray tubes that are positioned between the rows of heat exchange tubes and longitudinally aligned within the generally triangular or rectilinear open regions defined by the finned tube pitch. As will be illustrated below, each open region contains one spray tube that is co-extensive in length with, and generally centered between the adjacent finned tubes. The spray tubes are provided with spaced-apart nozzles to ensure a uniform dispersal of the spray over the adjacent finned tube surfaces. It is to be understood that the term "spray tube(s)" as used in this description includes the tubes that are arranged and configured to carry the liquid and/or air for distribution by the spray nozzles, as well as the tube(s) with the nozzles affixed as a unitary construction. In some embodiments, the term "nozzles(s)" is used to describe a separate element that is secured to, and extends from the exterior surface of the spray tube, or to refer to a plurality of openings or orifices in the walls of the tubes through which the pressurized fluid in the tubes is emitted for the purpose of cleaning and/or cooling the adjacent and surrounding finned tube surfaces. In either form, the nozzles are dimensioned and configured to maximize the efficient utilization of the fluid discharged for the purpose of cleaning the finned tubes and cooling or heating, the process fluid to achieve and maintain the target temperature.

In an embodiment where cooling is required, the nozzles deliver a cooling liquid in the form of dispersed streams, e.g., as from a convention shower head. In an embodiment, the nozzles discharge a mist of small droplets in compressed air that are more effective in the evaporative cooling of the ambient air that passes over the fins, or compressed air containing solid abrasive particles to dislodge dirt from the surface of the fins. At low ambient air temperatures, steam can be discharged from the nozzles.

The system includes one or more manifolds with which the spray tubes are in fluid communication. The manifold(s) in turn are in fluid communication with a reservoir or other external source of the pressurized fluid that passes through the tubes and is discharged from the nozzles.

The apparatus for use in the system and in the practice of the method of this disclosure broadly contemplates providing a common manifold that is conveniently positioned proximate a header at one end of the ACHE and that extends and transverse to, and above the top row of finned tubes where they enter the header. A pressurized fluid, which can selectively be provided as a liquid for cleaning and/or cooling, or in the form of a cooling or heating gas, e.g., air, either alone or as a carrier for directing solid particles to aid in dislodging accumulated dirt from the tube fins to improve the heat transfer efficiency. The liquid or gas is provided to the common manifold from an external source at temperatures and pressures that are predetermined based upon operational requirements of the ACHE. The pressurized fluid is provided to each of the individual spray tubes via a connecting conduit that is in fluid communication with the interior of the common manifold. The intermediate conduit can be in the form of an array manifold that depends from the common manifold, passing between the ends of the finned tubes adjacent the header, with the ends of the spray tubes affixed in fluid communication to the array manifold. Alternatively, each of the spray tubes can be fabricated in an L-shaped configuration, e.g., by bending a flexible length of tubing, and individually connecting each tube in fluid communication to the common manifold. In this latter embodiment, it will be understood that the ends of the spray tubes will be arranged in groups between the finned tubes and they are individually connected to the common manifold. The choice from these alternate configurations for supplying pressurized fluid to the spray tubes from the common manifold can be based upon the physical configuration of the principal elements of the ACHE, including particularly the spacing between the finned tubes at the header, as well as the vertical alignment or displacement of the finned tubes from row to row. These alternative arrangements are described in more detail below.

In an embodiment that is especially adapted to clean dust and dirt and other debris from the finned tubes, the manifold is provided with a source of pressurized water, or optionally an aqueous solution containing a cleaning additive, e.g., a detergent or chemical agent, to facilitate removal of the accumulated dust, dirt and any other debris. In a preferred embodiment where the ACHE unit is in continuous operation, the temperature of the water is controlled to optimize the desired temperature reduction of the process liquid passing through the finned tubes during the course of the spray cleaning operation.

In another cleaning embodiment, a mixture of compressed air and abrasive particles, e.g., bicarbonate of soda, are discharged at a predetermined pressure through the nozzles to dislodge the accumulated dust and debris. Other known organic and inorganic abrasives that do not erode the finned tubes, spray tubes, nozzles and other materials of construction can also be used in this embodiment.

In an embodiment that is especially adapted for operation in an environment having high ambient temperatures, the manifold of the spray tubes is also connected via an appropriate arrangement of valves and pressure regulators to a source of pressurized air that is cooled to a predetermined temperature based on the ambient air temperature and the desired target temperature of the cooled process liquid as discharged from the ACHE.

The system can be controlled manually by a single operator who monitors the ACHE outlet temperature and pressure. If the target temperature cannot be achieved in the summer, the operator can introduce the cleaning medium to improve the heat transfer efficiency of the finned tubes. If the target temperature still cannot be achieved, the operator initiates the introduction of compressed air to form a water mist, and if necessary, cooled air from an external source.

The system can also include appropriate sensors, valves and optionally pumps to provide a controlled discharge volume of cooled air and water mist to achieve the desired cooling where the ambient air surrounding the ACHE unit is too hot to achieve the required cooling of the process liquid.

In an embodiment that is especially adapted for operation in an environment having low ambient air temperatures, the spray tube manifold(s) are in fluid communication with a source of pressurized heated air, the flow rate of which is controlled as described above to provide the appropriate temperature in cold climates to achieve the desired temperature change in the process liquid that is discharged from the ACHE. If the flow of heated air from the nozzles is not sufficient to meet the target temperature, steam is introduced into the manifolds and discharged through the nozzles. The temperature and pressure of the steam is determined by the operator in order to assure that the process fluid discharged from the ACHE is at the target temperature.

From the above descriptions, it will be understood that an important feature of the system is the introduction of heated or cooled air to assure controlled operating temperatures in the ACHE in order to achieve the desired temperature reduction of the process liquid passing through and exiting the unit.

The system of each of the above embodiments preferably includes one or more temperature sensors that transmit signals to provide a visual display and/or to store the information in a memory device associated with a microcontroller or processor to execute one or more programs or routines to provide and send a signal to adjust one or more volumetric flow valves and/or to control the heating/cooling means, respectively, to raise or lower the temperature of the pressurized fluid that is being discharged through the spray nozzles of the spray tubes. The system also includes automated controls that adjust the volume and/or temperature of the fluid sprayed on the finned tubes in response to the actual temperature of the process liquid. For example, ambient air temperature sensors monitor periodically or continuously for changes so that the degree of heating or cooling of the air supplied to the inlet of the manifold(s) of the present system can be adjusted in response to a rise or fall of the ambient air temperature. In addition, or in the alternative, the pressure and/or volume of air supplied to the spray tubes and nozzles via the inlet manifold(s) can be periodically adjusted to effect the desired change.

As will be understood by one of ordinary skill in the art, a single ACHE unit constructed in accordance with the spray tubes, nozzles and manifold(s) of the present system can be supplied sequentially with heated or cooled water, with or without a cleaning additive, to meet the requirements for cleaning the ACHE finned tubes, and thereafter with heated and/or cooled air to direct cooled or heated air to achieve the desired cooling of the process liquid passing through the tubes. In each of these three modes of operation, the alternative exists to cease or continue operation of the ACHE unit's fans at a controlled speed. In general, the capabilities and costs of supplying large volumes of temperature-controlled water for cleaning will favor the use of heated or cooled air when ambient conditions enter extremes of temperature that render the use of the fans ineffective to achieve the desired temperature range of the process liquid.

The present disclosure is therefore broadly directed to ACHE units that are provided with a permanently installed array of spray tubes each fitted with spray nozzles that are arranged to direct a fluid, e.g., an air or liquid spray, against all of the finned tube surfaces in a multi-level array of finned tubes, where the spray tubes are in fluid communication with one or more manifolds that assure an even distribution of the pressure- and temperature-controlled fluid to the spray tubes.

The system can operate to clean using only compressed air and a dry particulate abrasive, e.g., sodium bicarbonate, that are mixed in the header or manifold and that is discharged through the nozzles to clean accumulated dust from the fins. In extremes of ambient temperatures, externally cooled water and compressed air is discharged as a mist to effect evaporative cooling in the tube bundle to maintain the target temperature. When heating is necessary due to low ambient air temperatures, steam or hot air is introduced to maintain the target temperature.

In the embodiments described below and in the accompanying figures, the ACHE finned tubes are positioned horizontally in vertically displaced rows. As will be understood by those of ordinary skill in the art, the rows of finned tubes can also be mounted at an angle that is acute to the horizontal for installations requiring a smaller foot print. The relative positioning of the manifolds and the spray tubes, as well as the control systems will be understood by one of ordinary skill in the art to be readily adaptable regardless of the specific orientation of the ACHE finned tube array.

The apparatus and system of the present disclosure is preferably constructed with a single common manifold that extends transversely across the top or upper row of the finned tubes and is configured and dimensioned to receive and distribute the pressurized fluids. The common manifold is conveniently positioned proximate the inside face of the ACHE header to which the finned tubes are attached in fluid communication or to the header at the opposite end of the unit.

In an embodiment, a plurality of array manifolds extend downwardly from the common manifold between the adjacent finned tubes. The lower-most ends of the depending array manifolds are sealed. A plurality of horizontal spray tubes are secured in fluid communication with each of the depending vertical array conduits and extend horizontally between the rows of finned tubes in the ACHE. When the horizontal common manifold is pressurized with the spray fluid, it passes through each of the depending array manifolds and into each of the spray tubes extending along the length of the array of finned tubes, and is discharged through the nozzles as a fluid spray, i.e., as a liquid or gas, depending upon the ambient conditions and the predetermined need for the operation of a cleaning cycle.

In an alternative embodiment, each of the spray tubes is connected directly to the common manifold that extends transversely above the top row of the finned tubes of the ACHE. Assuming that the ACHE is comprised of X rows of finned tubes, either a corresponding number of "N" spray tubes will extend longitudinally above each of the rows of finned tubes, or optionally "N+1" rows will be employed with a row of spray tubes beneath the bottom row to assure thorough cleaning of all portions of the fins at each level. The latter arrangement may be desirable where the cooling is by forced draft and the lower-most row of finned tubes is subjected to dust, dirt and/or sand carried in the air from the environment below the ACHE supporting structure. In dry, dusty and/or sandy regions of the world, it is common to elevate the finned tubes and the entire ACHE assembly well above ground level where dust and sand are easily rendered airborne by passage of vehicles and/or windy conditions to avoid having excess dirt picked up by the fans and blown into the finned tube array.

The end of each horizontal spray tube tell iinates at a position generally below the horizontal common manifold and is provided with a right angle bend and an appropriate length of spray tubing to be connected in fluid communication to the common manifold. As will be understood by those of ordinary skill in the art, all connections must be secure and fluid-tight, and the entire constructed assembly must be sufficiently robust to withstand the forces encountered during installation and throughout continuous operation, including changes in temperature and in the medium being passed through the spray tubes and discharged from the spray nozzles.

Spray tubes can be positioned above the top row and below the bottom row of the finned-tube bundle, with the spray nozzles appropriately aligned to direct their discharged spray onto the adjacent finned tubes.

Monitoring and Control System

In an embodiment, temperature sensors are installed to monitor and provide signals corresponding to the temperature of the process liquids passing through the finned tubes. Sensors can be placed on the exterior of the finned tubes and/or fitted with probes that extend through the wall of the tube into contact with the process liquid. These sensors are conveniently placed at the inlet or outlet end of the finned tubes at locations where fins are not present. Temperature sensors can also be placed in the inlet header and/or the outlet header. Signals from the sensors are transmitted to a processor and stored in a memory device. Temperature and humidity measuring devices are located in proximity to the ACHE in order to monitor and record ambient conditions over time. After a period of operating experience, i.e., through seasonal or cyclical changes in the local ambient weather conditions and/or by reference to historical records, programs can be created to operate the system efficiently and anticipate the volume and/or pressure and temperature of heated and/or cooled air to be passed through the spray tubes in order to maintain the desired outlet temperature of the cooled process liquid.

It will be understood that the ACHE will continue to operate with a conventional forced draft or induced draft air system when ambient air temperatures pennit the process fluid to be cooled to the required temperature range. Thus, the use of the spray tubes with heated or cooled air and a mist of water is intended as an auxiliary measure for guaranteeing the desired cooling when environmental conditions are so extreme that merely controlling the speed of the fans that move the ambient air through the ACHE are insufficient to meet process specifications. It will also be understood that the system of the present disclosure can operate in conjunction with cooled air from an external source that is introduced via ducts or other known means into the induced or forced air flow passing into the housing containing the tube bundle.

Likewise, the periodic cleaning of the ACHE with water can be scheduled so that the temperature of the water applied to clean the finned tubes will complement or completely obviate the need to operate the fans. Water flowing from above-ground uninsulated storage vessels or towers in desert environments generally achieves a temperature approaching that of the daytime ambient temperature due to solar heating. Sensors in contact with the water supply transmit a signal to the processor which includes a conventional algorithm to determine whether the temperature of the wash water must be raised or lowered during the washing cycle to achieve the desired cooling of the process liquid. Any required increase or decrease in the washing water temperature can be achieved, e.g., by mixing a predetermined proportion of warmer or cooler water from a separate source, or alternatively by direct heating or cooling of the washing water by conventional heat exchange, e.g., using hot combustion gases or stream, or a refrigeration device through which the water is passed. Since the wash water must be pressurized, temperature control can be conveniently achieved in a storage or accumulator vessel.

Selection and placement of temperature sensors, monitoring and control systems as described above are well within the skill of workers in the heating, air conditioning and ventilating art, as is the automation of control systems. Operators responsible for the existing ACHE units will also have developed programs and standards for monitoring the performance of the units based on local climatic conditions, and the accumulation of dust and debris on the finned tubes for the timing of periodic cleaning, which experience and information can also be incorporated into an automated control system for the present method and apparatus.

BRIEF DESCRIPTION OF THE DRAWINGS

The invention will be described in further detail below and with reference to the attached drawings, where.

DETAILED DESCRIPTION OF EMBODIMENTS

Figure 1:
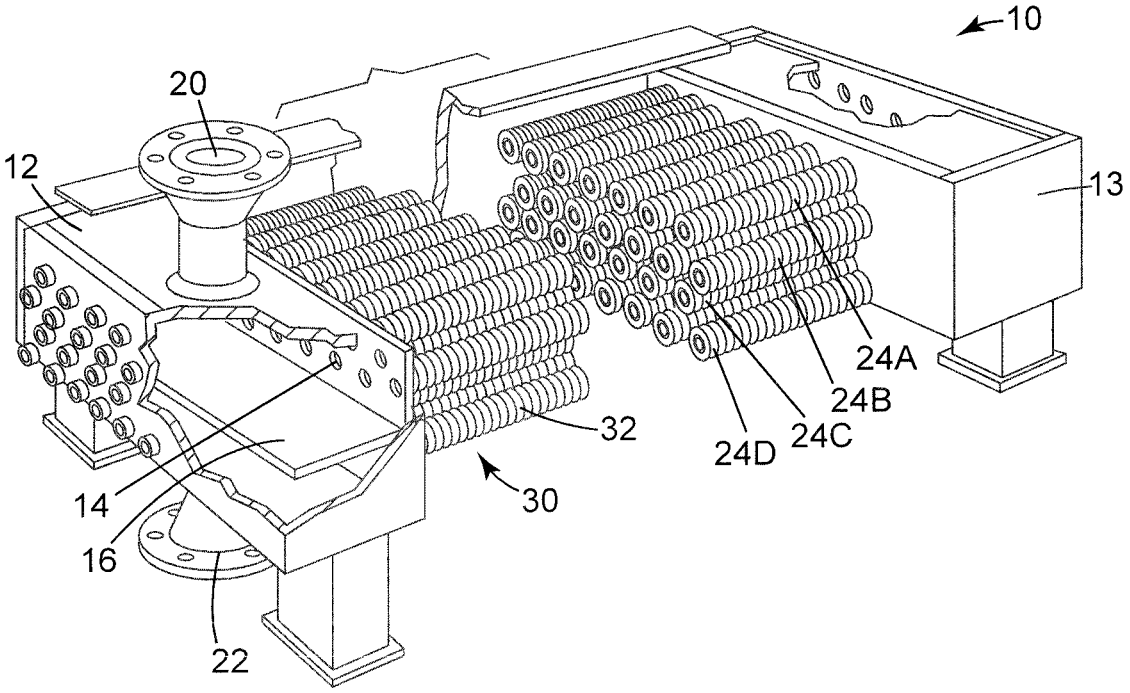
FIG. 1 (Prior Art)
FIG. 1 is a top, front perspective exploded view, partially cut away, of an air cooled heat exchanger ACHE of the prior art.

The apparatus, system and method of the invention will be described with reference to a horizontal ACHE that is configured generally as shown in the illustration of the representative prior art unit of FIG. 1. As illustrated, the ACHE 10 includes inlet header 12, tube sheet 14, a horizontally finned tube array 30 composed of a plurality of finned tubes 32 that are illustratively positioned in four horizontal rows (24A, 24B, 24C, 24D). The inlet header is divided by partition wall 16 and is fitted with hot process liquid inlet 20 and cooled process liquid outlet 22. Opposing header 13 returns the process liquid through the lower rows of finned tubes to the discharge portion of header 12.

Figure 2:
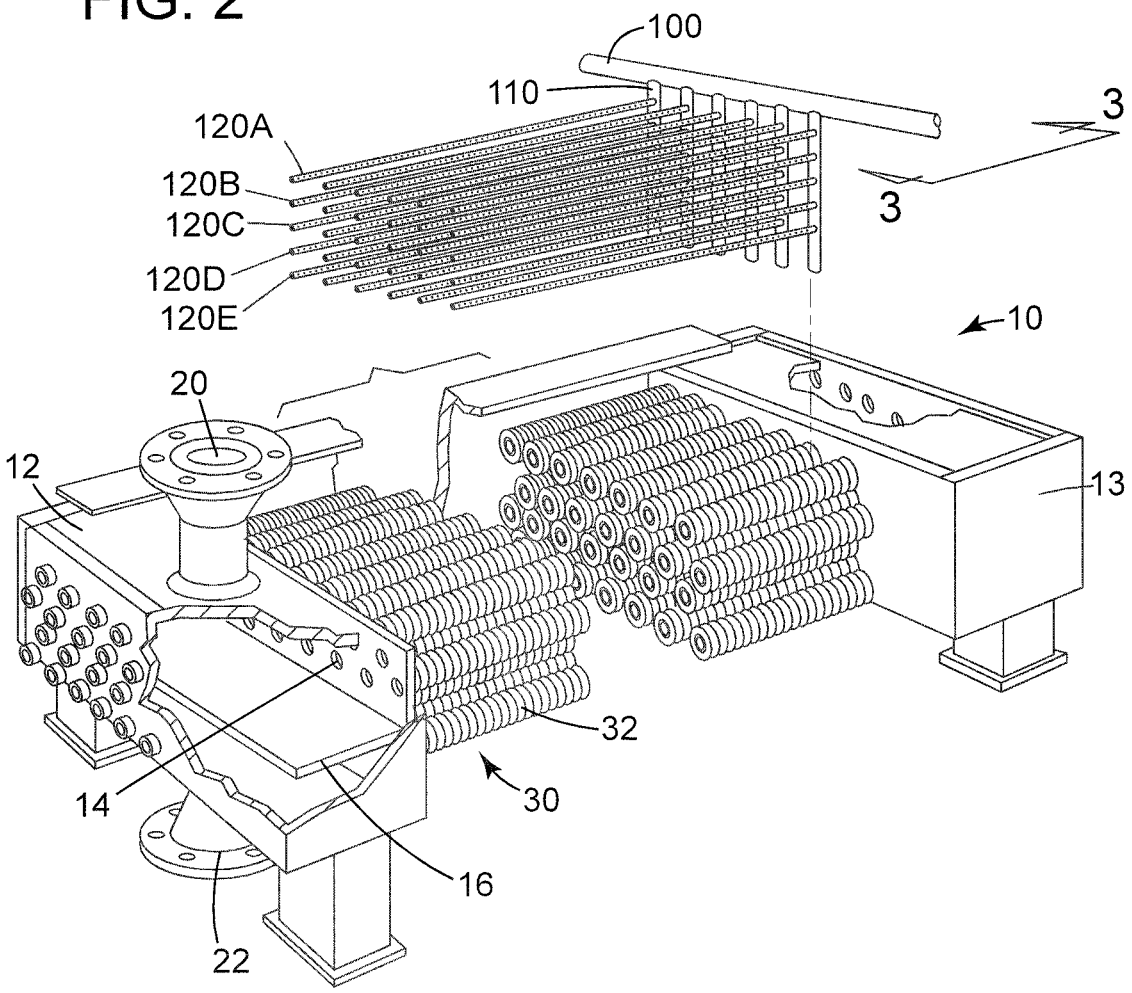
FIG. 2 is a schematic exploded representation of an embodiment in accordance with the invention employing a common manifold with a plurality of vertically depending array manifolds, each of which array manifolds is fitted with a plurality of horizontally extending spray tubes each having a simplified representation of a plurality of spray nozzles for installation in an ACHE configured generally as illustrated in FIG. 1.

Referring now to FIG. 2, an ACHE of a construction similar to that of FIG. 1 is fitted with a common manifold 100 of the present system that is shown in the exploded position extending transversely above the top row of the array of finned tubes 30. As illustrated here, the common manifold 100 is provided with a total of six downwardly depending array conduits 110 which fit between the unfinned portions 34 of tubes 32 as will be described in more detail below with reference to FIG. 4. In this embodiment, each of the vertical array manifolds 110 is provided with a total of five horizontal spray tubes 120A-120E, which are configured and dimensioned to pass between the spaces defined by the peripheries of the fins 36 projecting from the four horizontal rows of tubes in the array 30. For ease of illustration and to facilitate the understanding of the principal features and functions of the elements making up the system and apparatus, the spray tubes 120A-120E are shown with orifices 122 in this embodiment. As will be explained and illustrated in more detail below, the orifices 122 are provided in other embodiments with individual spray nozzles that project from the surfaces of the spray tubes 32.

Figure 3:
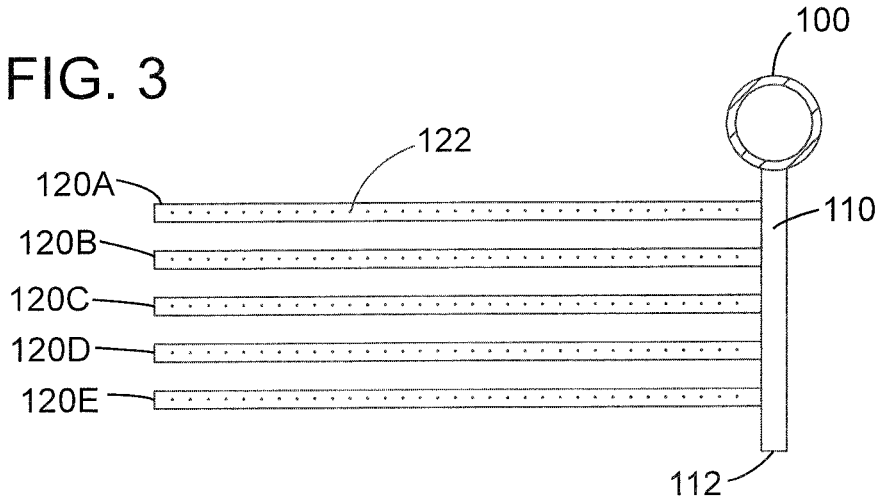
FIG. 3 is a simplified schematic side view taken along line 3-3 illustrating the embodiment of the assembly of the manifolds and spray tubes with nozzles shown in FIG. 2.
Figure 4:
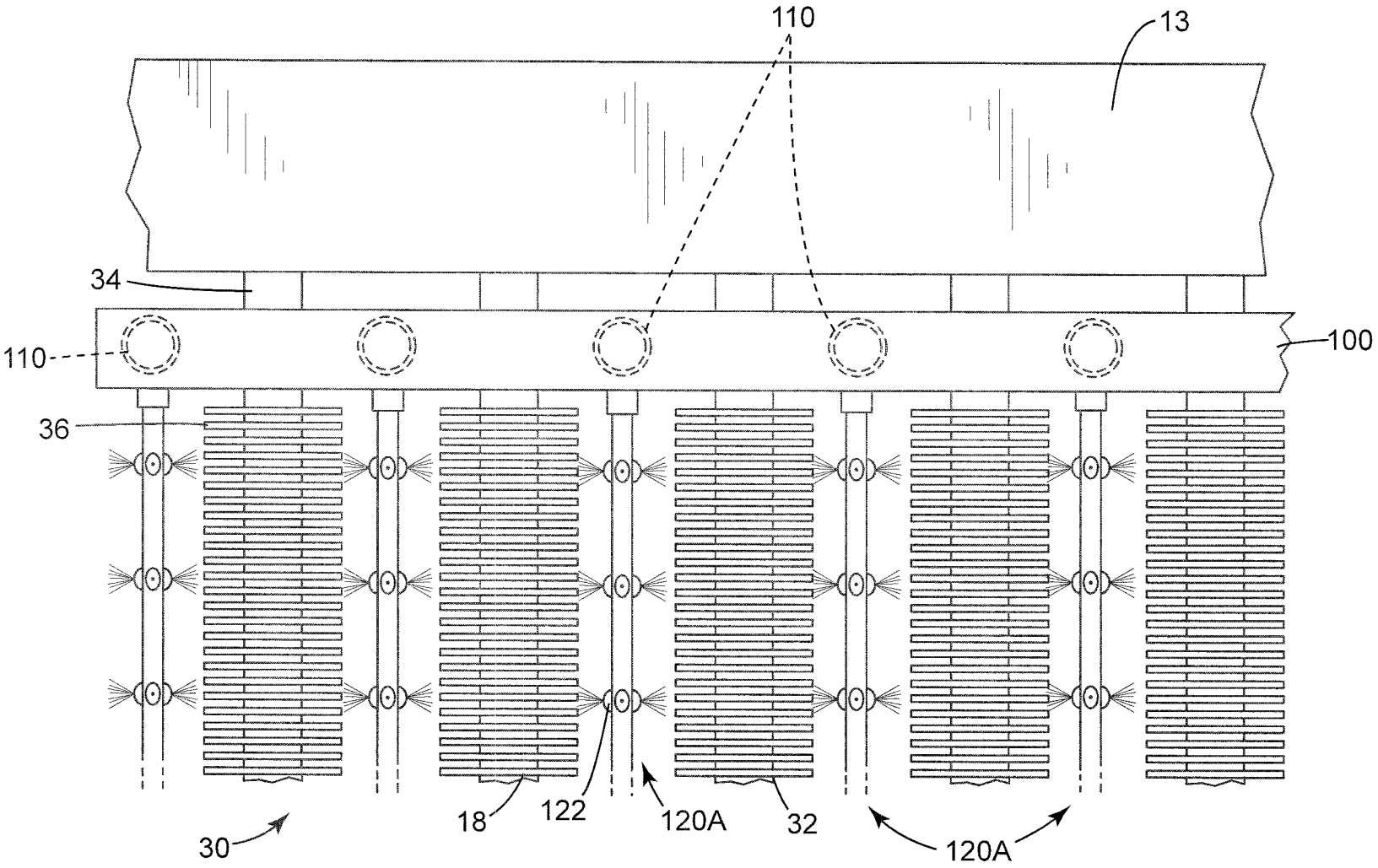
FIG. 4 is a top plan view illustrating the installation of the common manifold system shown in FIG. 2 with the vertically depending array manifolds shown in phantom.

As best shown in the representative side elevation of FIGS. 3 and 4, each of the horizontal spray tubes 120A-120E is provided with a plurality of spaced-apart spray orifices/nozzles 122 which are dimensioned and configured to provide a generally spherically extending spray pattern, the spray from each of the nozzles 122 overlapping with that of adjacent nozzles to assure contact with and a thorough cleaning of the surfaces of the adjacent fins 36. In a preferred embodiment, spray nozzles suitable for use in spraying both water and hot/cold air, and that operate over available pressure ranges with each of the two mediums are installed on the spray tubes. As also illustrated in FIG. 3, the common manifold 100, shown in cross-section, is fitted in fluid communication with depending array manifolds 110, each of which is sealed at its lower end 112. The array manifolds 110 can be secured in a rigid fluid-tight relation to the common manifold 100 by providing threads to the respective components or by welding, or both. The spray tubes 120 can be supported at the end opposite the array manifold and optionally or alternatively by temporary supporting brackets extending from between the fins 36 of one or more of the adjacent tubes 32.

The determination of the dimensions of the pressurized fluid conduits, flow rates, and size and capacity of the nozzles and other design parameters for the systems described above are within the skill in the art.

The various carrying manifolds, tubes and nozzles of the system can be fabricated from metal and/or polymeric stock, of standard shapes, i.e., round or rectilinear, and wall thicknesses, that are selected based on the operating pressures of the system, and the temperature ranges encountered.

Considerations of cost and ease of fabrication can favor commercially available tubes and conduits extruded from polymeric materials, which can also provide resistance to cleaning additives and to the corrosive effects and build-up of minerals and the like in water used for washing the finned tubes. Suitable polymers are PVC, copolymers of polyethylene/polypropylene, and other suitable materials that are known to those in the art.

The positioning of a representative spray tube 120A relative to a pair of flanking finned tubes 32 is shown in the top view of FIG. 4. The common manifold 100 is positioned over the unfinned end sections 34 of tubes from which the fins 36 have been removed or not assembled. The downwardly depending array manifold 110 is shown in phantom and the spray tube 128C is shown fitted with a plurality of nozzles 122 which illustratively are discharging a liquid spray. It will be understood from the above description, and as illustrated in FIGS. 2 and 3 in particular, that array manifold 110 is fitted with a plurality of spray tubes 120A-120E in a predetermined spaced-arrangement so that the spray tubes extend horizontally in the respective open spaces defined by the outer periphery of the adjacent finned tubes 32 forming the array 30. Although not specifically included in this illustration, it will be understood that each of the adjacent array conduits 110 is similarly fitted with a plurality of spray tubes.

Figure 5:
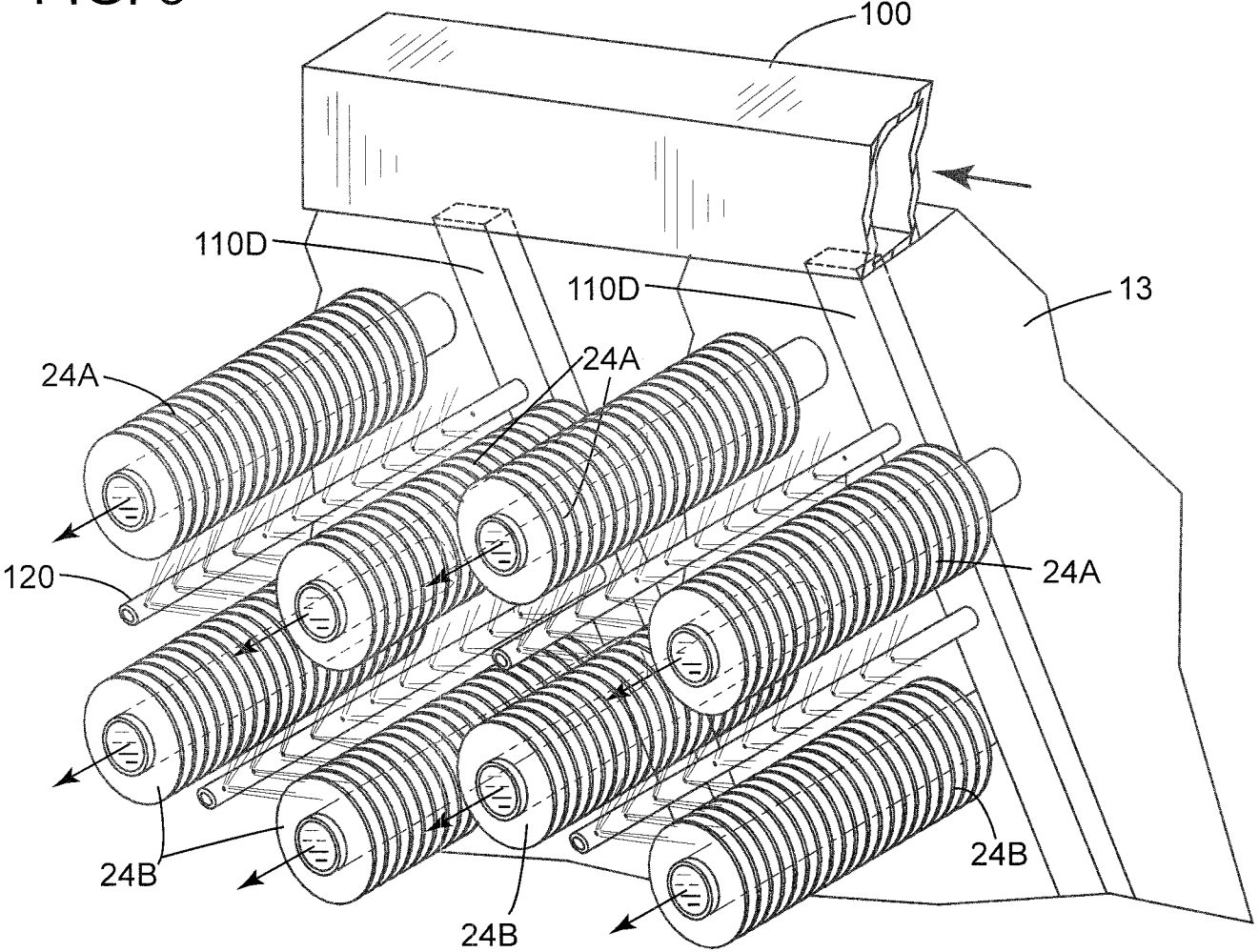
FIG. 5 is an enlarged perspective view representative of a portion of the apparatus illustrated in FIG. 4 in an embodiment in which the array manifold passes diagonally through the finned tube array.

In an alternative embodiment illustrated in FIG. 5, the array manifold 110D passes through the unfinned end sections 34 of finned tubes 32 at an angle, or diagonally, rather than vertically as shown in FIGS. 2, 3 and 4. The array manifold 110D is joined in this configuration to the common manifold 100 in a fluid-tight arrangement, e.g., by welding. The use of a diagonal configuration to pass through the horizontal tube array 30 can be utilized where the positioning of the individual tubes 32 making up the array 30 provide a relatively narrow vertical passage through the unfinned sections 34 of tube 32. It will be understood that the selection of a vertical or diagonally positioned array manifold is a matter of engineering design choice that may be associated with the pre-existing design configuration of the overall ACHE and that of the array of finned tubes 30.

Figure 6:
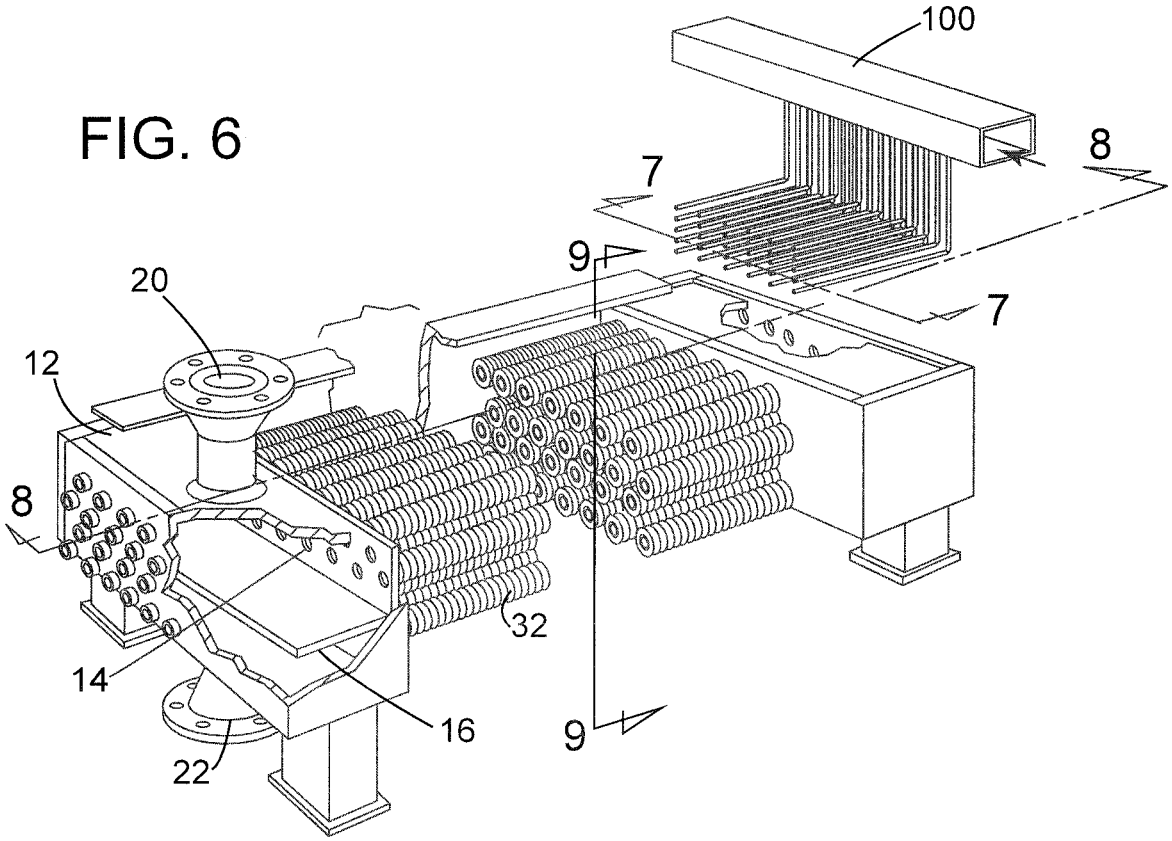
FIG. 6 is a schematic representation of an embodiment employing a common manifold to which are directly joined in fluid communication a plurality of "L" shaped tubes each having horizontally extending spray tube section for use in an ACHE configured generally as illustrated in FIG. 1.

An alternative arrangement for the configuration and attachment of the spray tubes to the common conduit 100 is illustrated schematically in FIG. 6. The basic configuration of the ACHE is as depicted and described in connection with FIG. 1, i.e., four rows of horizontal finned tubes 32 make up the overall array 30. In the embodiment shown in FIG. 6, the individual spray tubes are positioned above the first row of finned tubes, between each lower row, and a final spray tube is positioned below the bottom or fourth row as illustrated. Rather than having each of the spray tubes terminate at a spaced-apart position on a vertical or diagonally extending array conduit 110 as described above in FIGS. 2-4 and 5, respectively, the upstream end of each of the horizontal spray tubes 620A-620E is extended vertically and attached in a fluid-tight connection to the portion of the horizontal common manifold 100 that is above. The ends of the vertical lengths of the spray tubes are positioned proximate each other as they enter the common manifold 100. In this embodiment, the configuration of the manifold 100 is a matter of design choice, but a generally rectangular or oval cross-section will provide a larger surface area and aid in the convenient attachment and securing of the spray tubes in fluid communication with the interior of the common conduit 100. As will be understood by one of ordinary skill in the art, the spray tubes can be fabricated with fittings and/or bends to accommodate their passage through the adjacent unfinned tubes 34 and/or to be fitted to the common manifold 100.

Figure 7:
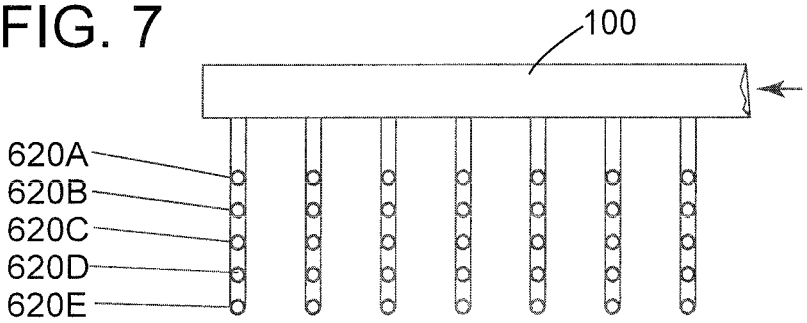
FIG. 7 is a side elevation view along section line 7-7 of FIG. 6 illustrating the arrangement of the common manifold, array manifolds and a representative positioning of the spray tubes.
Figure 8:
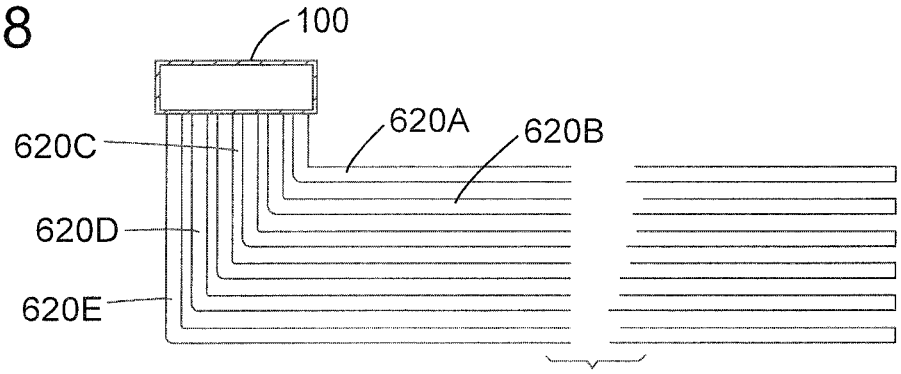
FIG. 8 is a front view taken along section line 8-8 of FIG. 6 illustrating an alignment of the vertical sections of the spray tubes with the common manifold as illustrated in FIG. 7.

The arrangement illustrated in FIGS. 7 and 8 represents a linear alignment of the upstream ends of the vertical portion of the respective tubes one behind the other as they enter the common manifold 100 along a transverse line to the longitudinal axis of manifold 100. Alternative arrangements can include off-setting the entry locations of alternate tubes to provide a more compact grouping of the connections.

Figure 9:
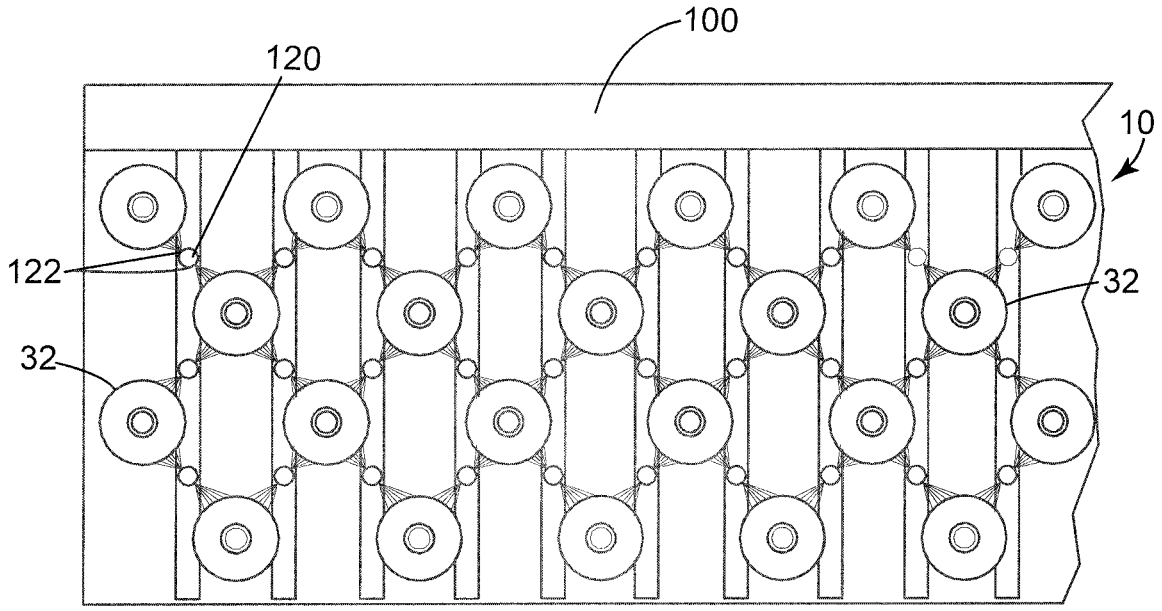
FIG. 9 is a cross-sectional view taken along section line 9-9 of FIG. 6 illustrating the relative positions of the spray tubes in the region between the finned tubes.

Referring now to the elevation view of FIG. 9, a representative embodiment of the positioning and spacing of the spray tube 120 and representative nozzles 122 between the finned tubes 32 is illustrated. The nozzles 122 are positioned and configured relative to each other to direct the fluid sprayed to contact the entire surface of the adjacent fins 36 and tubes 32 in order to efficiently and thoroughly clean and/or achieve the desired thermal effects. If desired, the run-off water can be recovered from beneath the ACHE for recycling to a storage vessel following any necessary filtration and/or other treatment, or the recovered water can be sent to the refinery's central treatment plant.

Figure 10A:
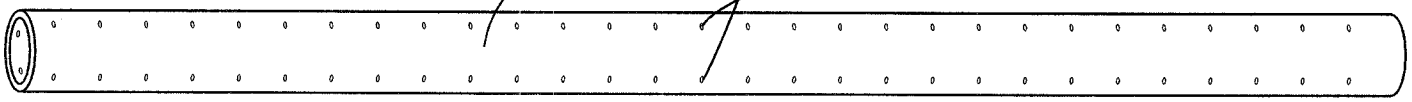
FIGS. 10A-10E are simplified schematic diagrams illustrative of embodiments of spray tubes provided with regularly spaced orifices and surface-mounted spray nozzles configured and positioned to apply a fluid spray to the adjacent finned tubes.
Figure 10B:
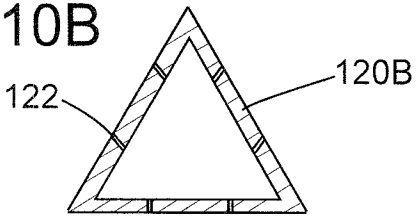
Figure 10C:
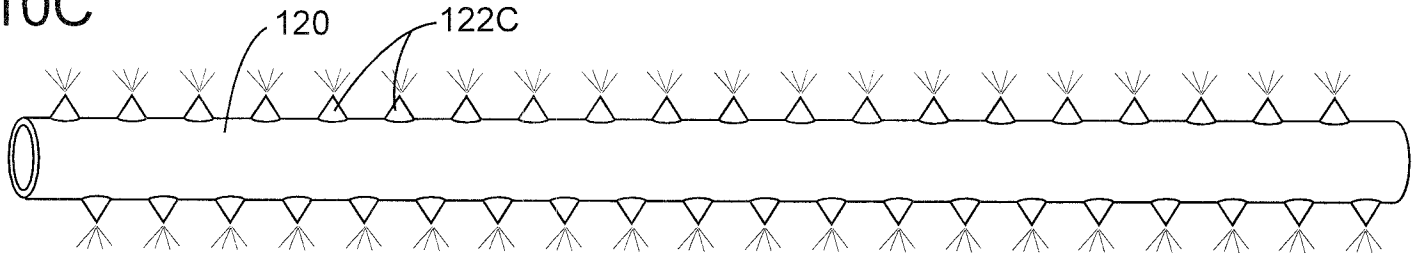
Figure 10D:
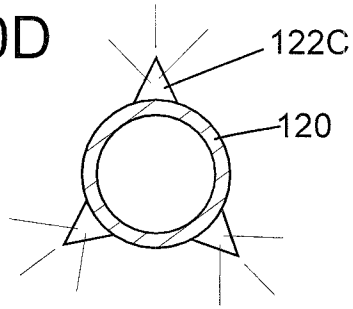
Figure 10E:
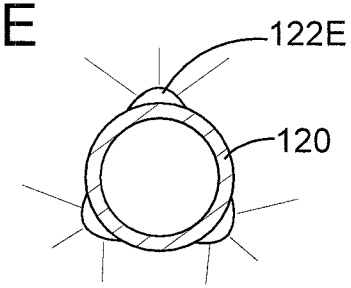

As was discussed generally above, the spray tubes 120 positioned between the finned tubes 32 can be of any convenient cross-section and an embodiment can be provided with regularly spaced-apart orifices in a pattern and orientation that will direct a washing or thermally adjusted fluid spray into the adjacent finned tubes. Referring now to the series of FIGS. 10A-10E, several embodiments will be described in more detail. The spray tube 120 of FIG. 10A corresponds to that illustrated in FIGS. 2 and 3 as tube 120 with a circular cross-section and has been provided with a plurality of orifices 122. As will be understood by one of ordinary skill in the art, the orientation as well as the diameter and configuration of the orifice, e.g., cylindrical, tapered inwardly or outwardly, can be selected to effect the desired pattern of the spray discharged under predetermined pressure conditions. FIG. 10B illustrates a spray tube 120B of triangular cross-section, the walls of which have been provided with a plurality of orifices 122C, each being configured and dimensioned to emit a spray of pressurized fluid along the length of the tube to contact the adjacent finned tubes. FIGS. 10C and 10D illustrate, respectively, a spray tube 120 of circular cross-section on which are mounted generally conical or pyramidal spray nozzles 122, each having in the embodiment shown a plurality of fluid spray outlets; alternatively, a nozzle discharging a single spray from a central outlet can be utilized. An example illustrating a spray tube 120 with a generally dome-shaped nozzle 122E is shown in the embodiment of FIG. 10E.

System Controls and Operation

Conventional ACHE monitoring and computerized control systems typically include sensors (e.g., pressure and temperature sensors) for monitoring and recording in memory for use by a programmed controller, the ambient air temperatures/pressure, hot process liquid temperatures/pressure upstream of the ACHE and downstream cooled process fluid temperatures/pressure, and preferably intermediate temperatures/pressure obtained as the process liquid passed through the finned tubes 32 and is subjected to the induced or forced draft air cooling. Signals generated by appropriate temperature sensors are passed to memory and subjected to a continuous program in a microprocessor, preferably dedicated to the operation of the ACHE unit. In most geographical locales, seasonal variations within a defined temperature range are predictable and the operation and speed of the fans can be controlled to maintain the required temperature reduction in the cooled process liquid within a prescribed range. As will be well understood by one of ordinary skill in the art, as local atmospheric conditions result in the accumulation of dust, debris and sand on the surfaces of, and between the fins 36 of the tubes 32 forming the array 30, the cooling efficiency decreases and the fans must be operated at a higher rate, thereby increasing energy consumption. As the accumulation of foreign matter on the fins 36 increases, the unit reaches a point at which it cannot achieve the required cooling. Present technology allows the accumulation of such data and corresponding graphics of tabular display, on screen or printed, if desired, so that operators can predict in advance when the unit must be cleaned to improve efficiency and maintain the desired degree of the cooling of the process liquid.

The arrangements of a maintenance control system 1000 suitable for use with an ACHE 1002 is described with reference to the schematic diagram of FIG. 11. The ACHE 1002 having a hot process liquid feed inlet 1020 and a cooled process liquid discharge outlet 1030 is shown positioned above at least one adjustable speed forced air fan unit 1010. The liquid feed inlet 1020 and liquid feed outlet 1030 can include downstream pressure/temperature sensors 1022 and 1032, as well as a pressure gauge 1050 for visually monitoring the pressure of the process fluid. A common manifold 1100 is schematically shown in this illustrative embodiment with a depending array manifold fitted with horizontal spray tubes 120 and spray nozzles 122.

The maintenance control system 1000 includes a cleaning system 200 for providing a liquid or dry abrasive spray to clean dust, dirt and other debris off of the finned tubes 32 of the ACHE 1002. The maintenance control system 1000 also includes a cooled air system 300 for cooling the process liquid in the finned tubes 32 when the surrounding ambient temperatures rise above a predetermined maximum temperature value and the forced air from unit 1010 cannot cool the process liquid. Additionally, the maintenance control system 1000 includes a heated air system 400 for heating the process liquid in the finned tubes 32 when the surrounding ambient temperatures drop below a predetermined minimum temperature value. The ACHE 1002 and maintenance control system 1000 can be operated by a programmable micro-controller or general purpose computer having specialized software programming for monitoring and implementing one or more cleaning routines (e.g., method 1200 of FIGS. 12A-12C) and cooling/heating routines such as described below with respect to FIGS. 13A-13D.

The cleaning system 200 includes a pressurized wash water vessel, e.g., a water tank 201 having valved inlets for ambient temperature wash water 202, chilled wash water 204 and heated wash water 206. It will be understood from this description that the temperature of the wash water is predetermined to effect the desired reduction in the temperature of the process liquid during the cleaning operation. Heated or cooled water is added to the ambient water to achieve the predetermined required temperature in wash water storage vessel 201. The outlet from the wash water storage vessel 201 includes a volumetric flow control valve 220 which is connected, via appropriate piping, to common manifold 1100 by a volumetric flow control valve 220. The flow of wash water from the control valve 220 to the common manifold 1100 can be monitored by the controller 1700 via a downstream pressure/temperature gauge 222. The common manifold 1100 includes a master flow control valve 1102. Pressurized cleaning additive vessel 208 is connected via valve 210 and conduit to the wash water storage vessel 201.

The cooled air system 300 includes an insulated pressurized cooled air vessel 301 and associated conduits which is also connected via appropriate piping to the common manifold 1100 via volumetric flow control valve 320. The flow of cool pressurized air from the control valve 320 to the common manifold 1100 can be monitored by the controller 1700 via a downstream pressure/temperature gauge 322. Ambient air enters air cooling apparatus 340 and is compressed via compressor 330 and passed to cooled pressurized air vessel (e.g., air storage tank) 301.

The heated air system 400 includes an insulated pressurized heated air vessel 401 that is likewise connected via appropriate piping to the common manifold 100 via volumetric flow control valve 420 and equipped with downstream pressure/temperature sensor or gauge 422. Air is drawn into heat exchanger 440 connected via air compressor 430 to the pressurized heated air storage vessel 401. Heat exchanger 440 can include direct heating means, such as radiant electric heaters (not shown) or steam via line 444.

Figure 11:
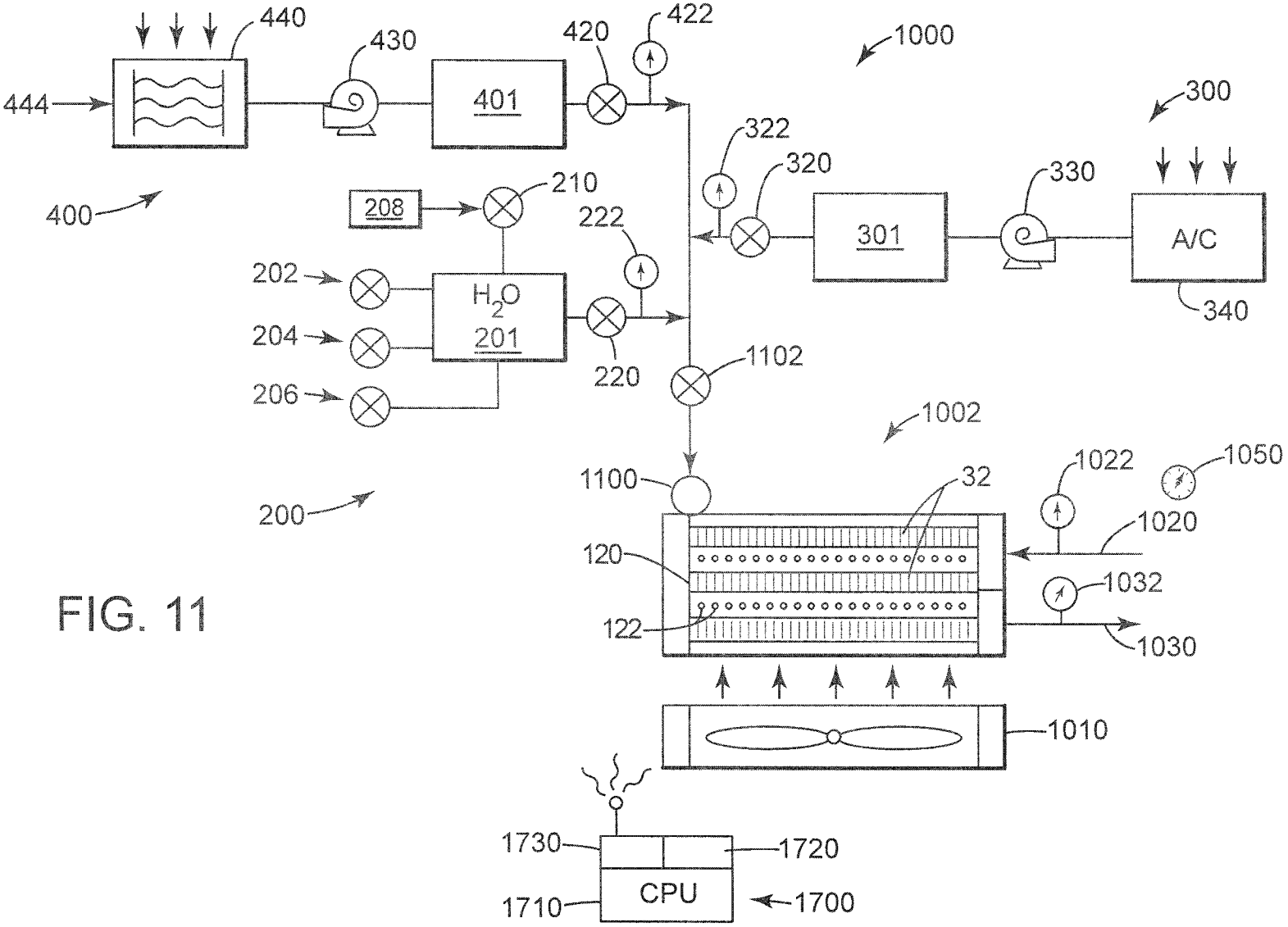
FIG. 11 is a schematic view of the system for providing wash water, cooled air and heated air for the maintenance and operation of the ACHE in various extreme climates.

As also shown in the schematic illustration of FIG. 11, an appropriately programmed microprocessor/control unit (e.g., "controller") 1700 which includes processor 1710, memory 1720 and transceiver 1730. As explained above, the apparatus and system 1000 is provided with electronic temperature and optionally pressure sensors or gauges (not shown) which transmit signals wirelessly via the transceiver 1730 or via appropriate circuitry (not shown) directly to the processor 1710 and memory device 1720 for use in the programmed operation of the system in one of the cleaning or cooling/heating modes described above. The details of automated cleaning or cooling/heating modes of operation are described in further detail below in connection with method 1200 of FIGS. 12A-12C and method 1300 of FIGS.

13A-13D, respectively. The volumetric control valves can be provided with conventional electronic valve actuators that are operable by signals from the processor/controller 1700.

As will be understood by one of ordinary skill in the art, based upon the operating experience of the system and the storage of data in the memory, the various embodiments can be fully automated. However, from a practical standpoint, operating personnel can be expected to monitor the operation of the ACHE 1002 and take note of the ability of the unit to control the discharge temperature of the cooled process liquid within the specified range. Thus, as the finned tubes 32 accumulate dust and/or debris, the efficiency of the unit will gradually decrease, i.e., increased fan speed will be required to achieve the desired cooling, thereby increasing the overall power consumption for the unit based upon prevailing ambient conditions. As the efficiency decreases over time, operating personnel will decide, based upon operating experience, to initiate the cleaning cycle to wash the debris from the finned tubes 32 in the array 30.

Assuming that the cleaning program is initiated manually, the programmed system will proceed as described above so that the ACHE 1002 can continue its operation without the passage of ambient air by the forced air fan unit 1010. Similarly, when ambient air conditions are such that the forced or induced air drafts cannot lower the process liquid temperature sufficiently, the wash water system 200 is shut down or maintained off-line and cannot be activated (i.e., no water flows to the common manifold 1100) so that the cooled air system 300 can be activated to pass cooled air through the common manifold 100 and to the spray nozzles 122 via the spray tubes 120.

Likewise when the ambient air conditions drop to a point where the process liquid is being cooled to temperatures below the specified range, the wash water system 200 is shut down or maintained off-line and the heated air system 400 will automatically initiate the process via the programmed operation to deliver hot air through the common manifold 100 and to the spray nozzles 122 via the spray tubes 120.

Figure 12A:
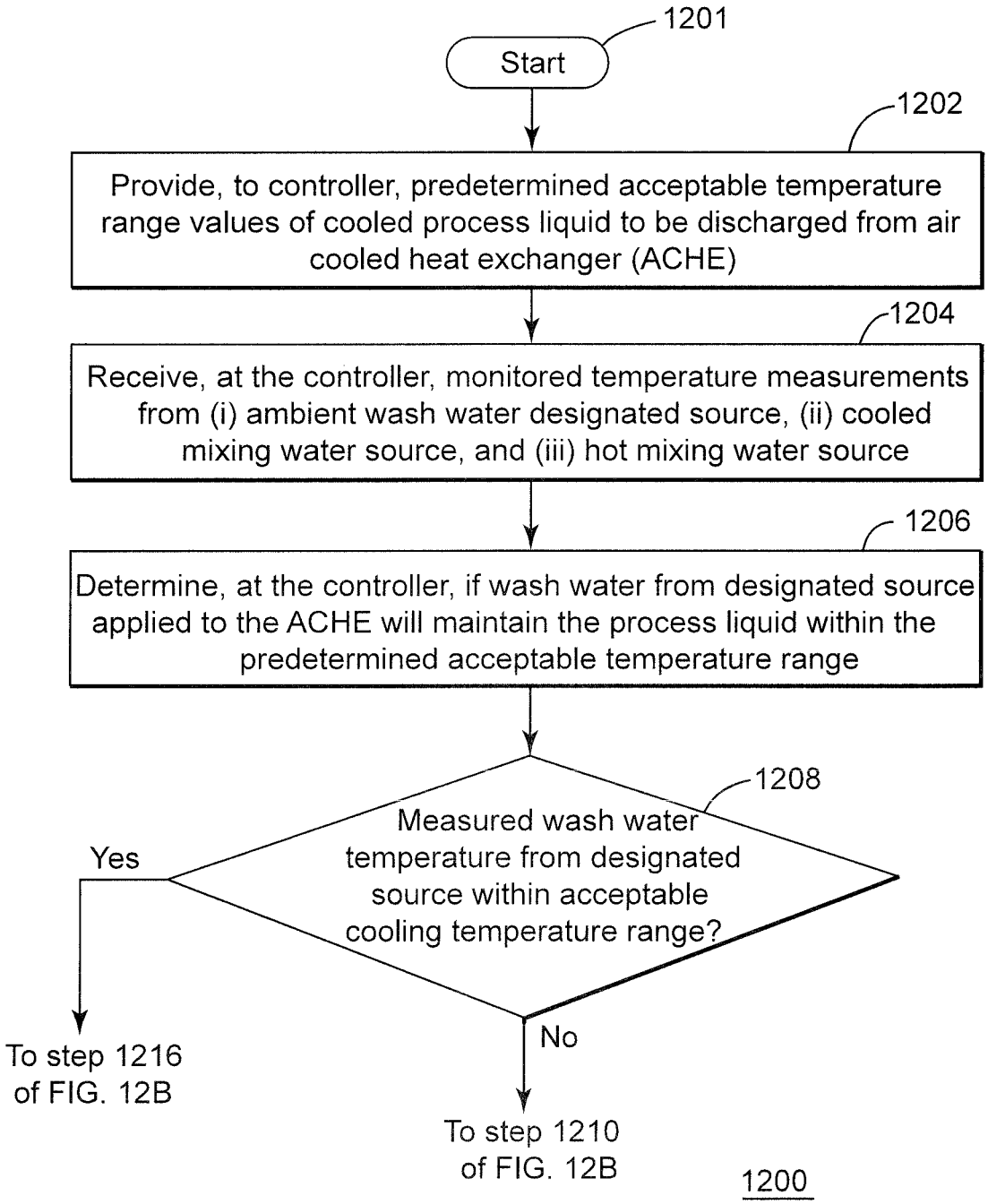
FIGS. 12A-12C is a series of process flow diagrams showing an automated cleaning operation for cleaning the finned spray tubes of the ACHE.
Figure 12B:
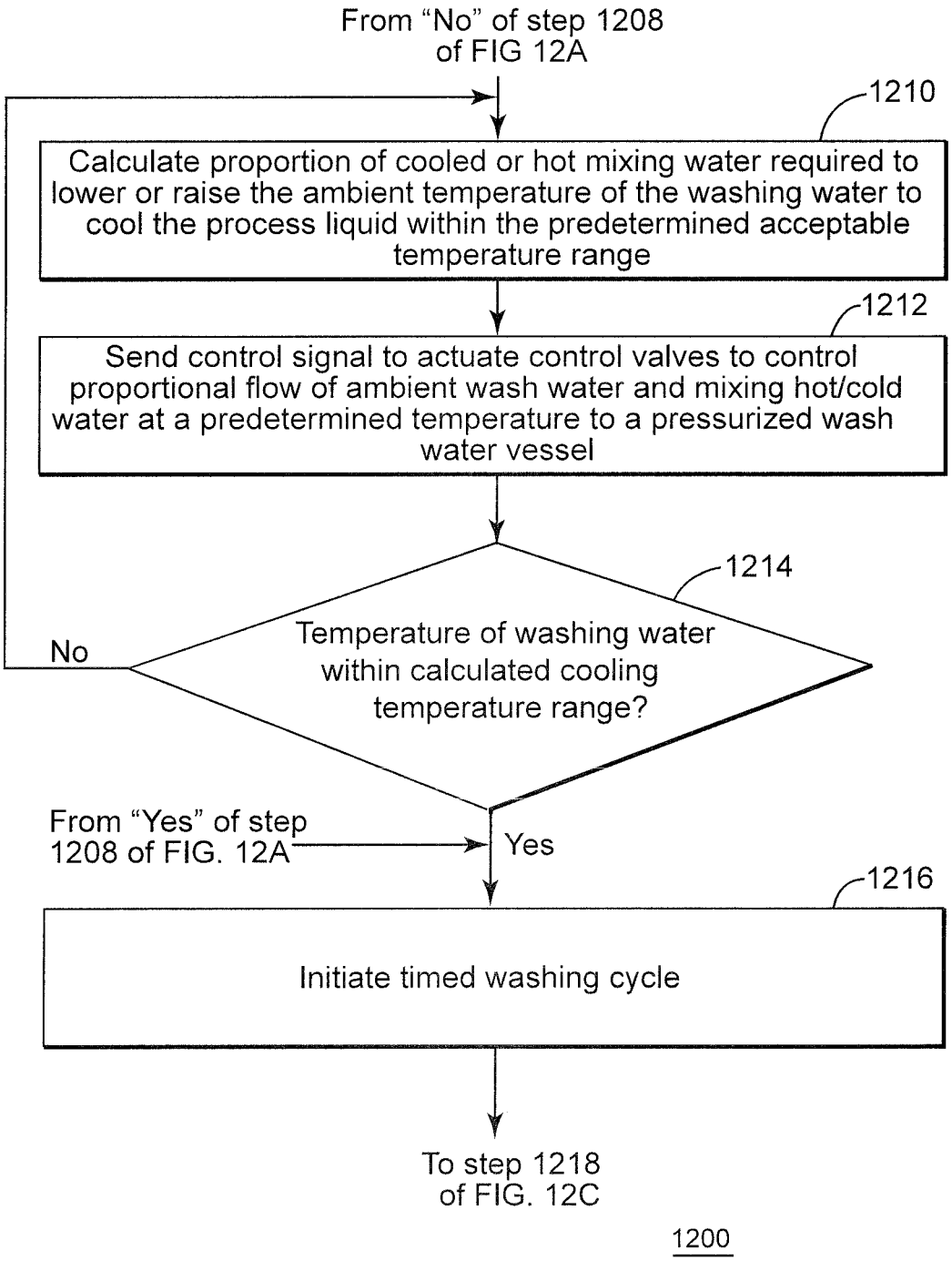
Figure 12C:
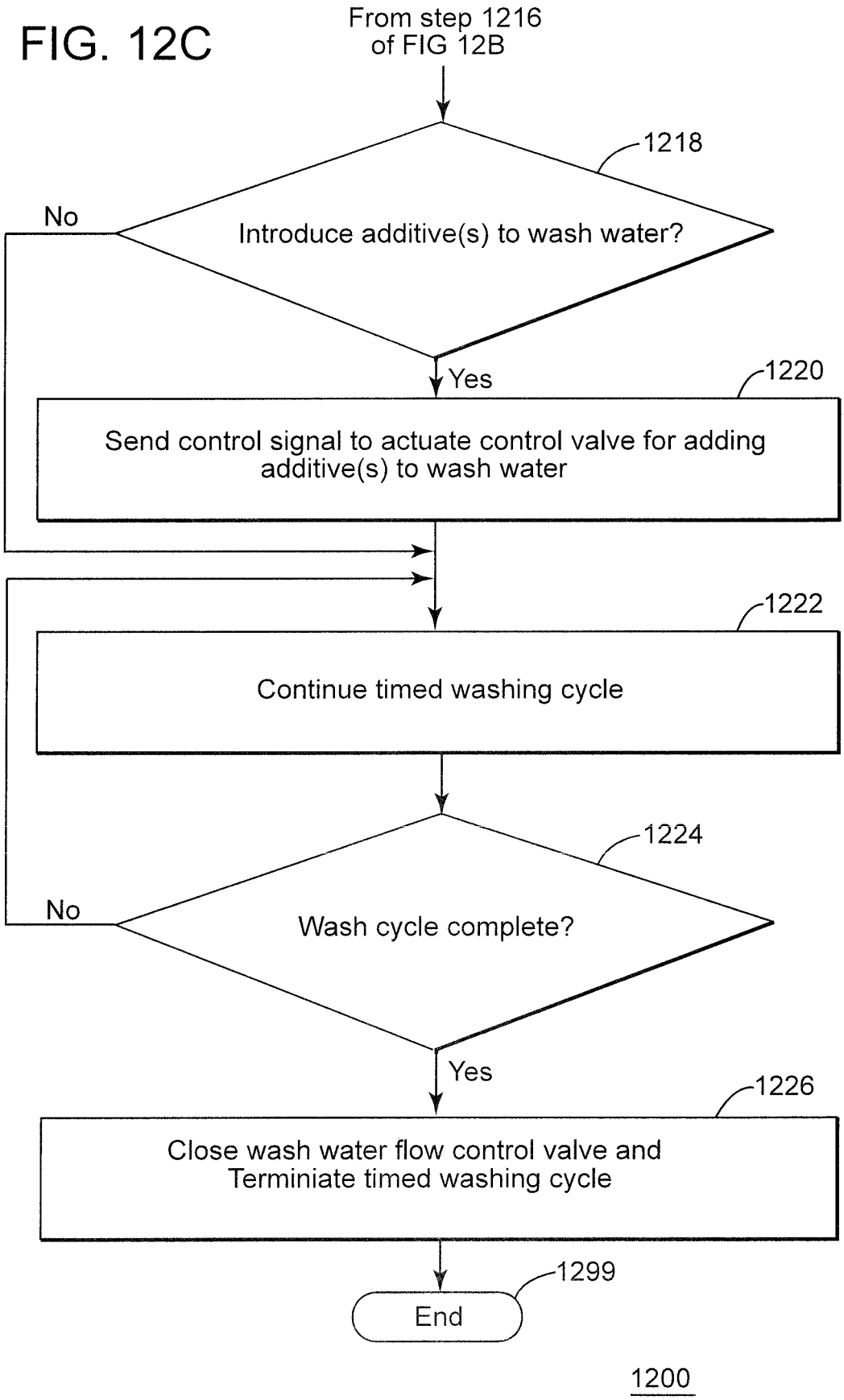
Figure 13A:
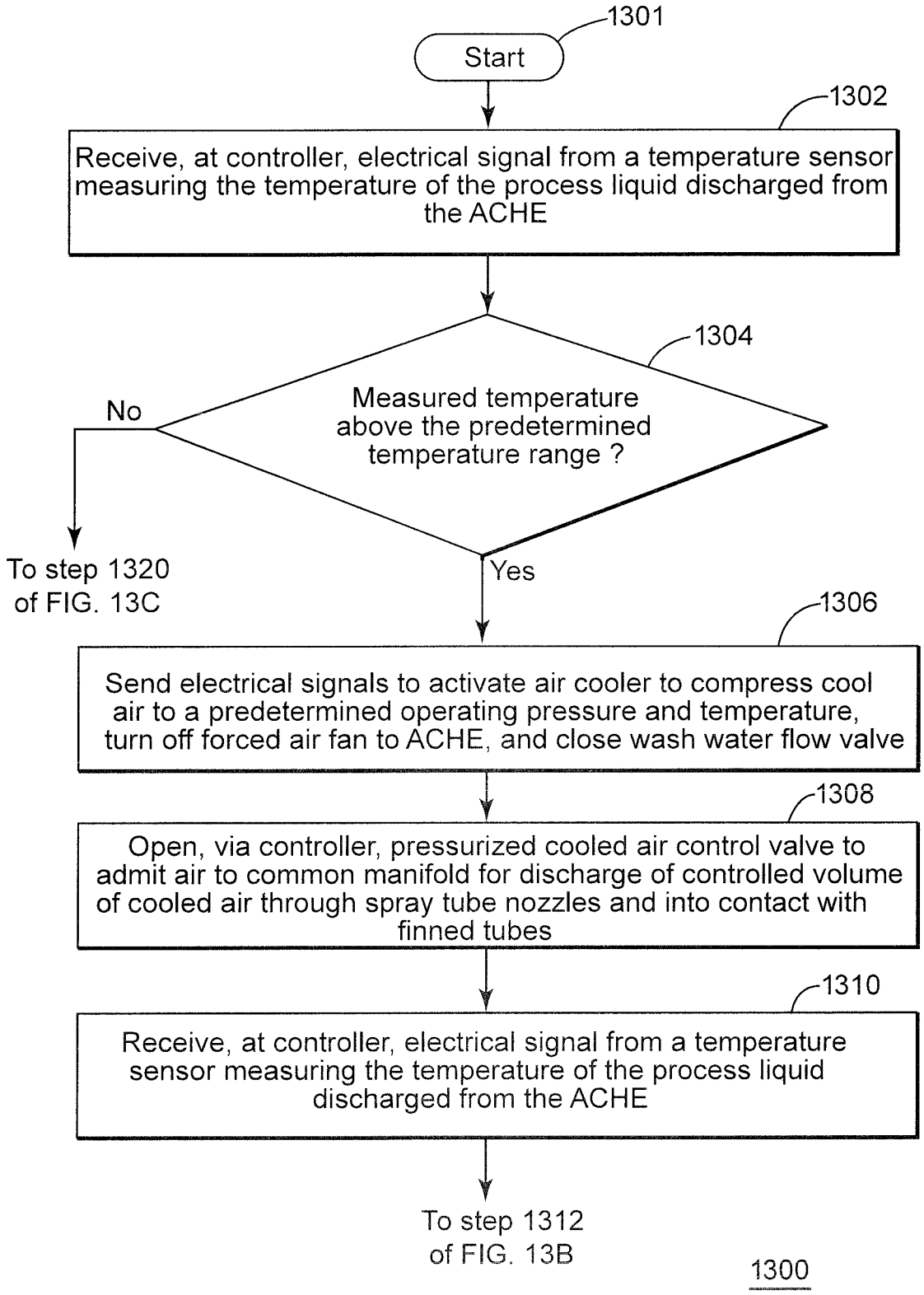
FIGS. 13A-13D is a series of process flow diagrams showing an automated operation for passing cooled or heated air during operation of the ACHE under extremes of ambient climate conditions.
Figure 13B:
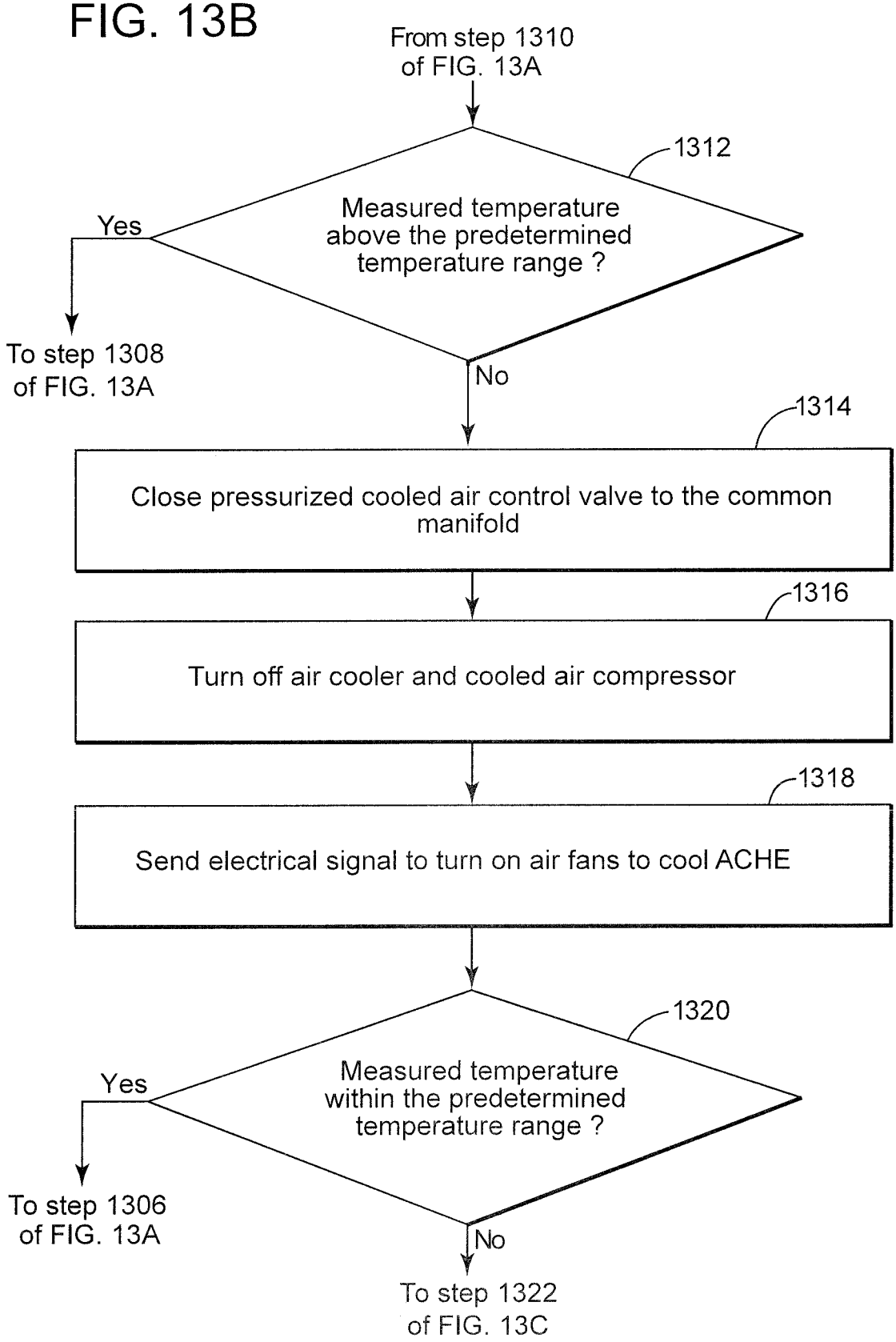
Figure 13C:
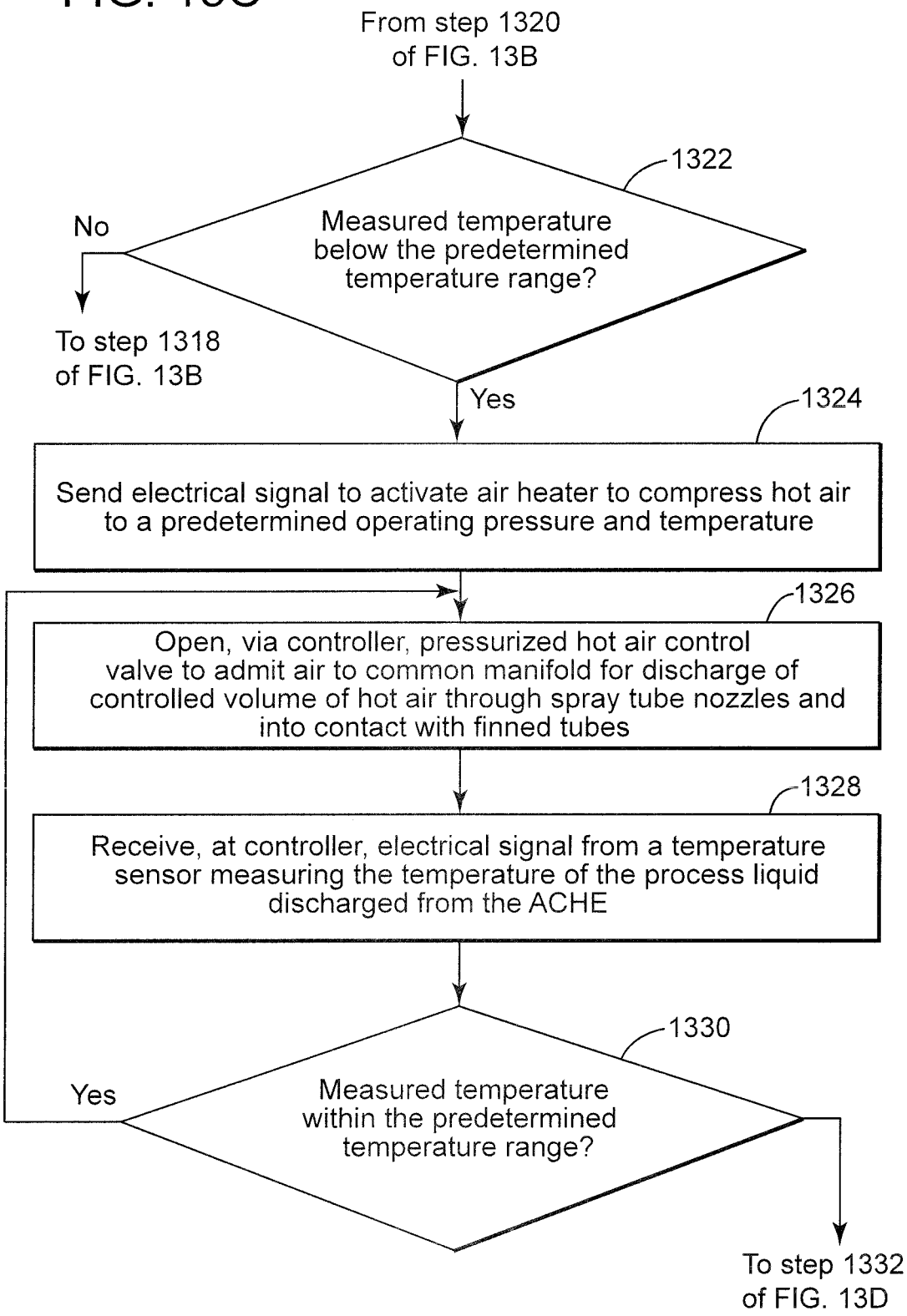
Figure 13D:
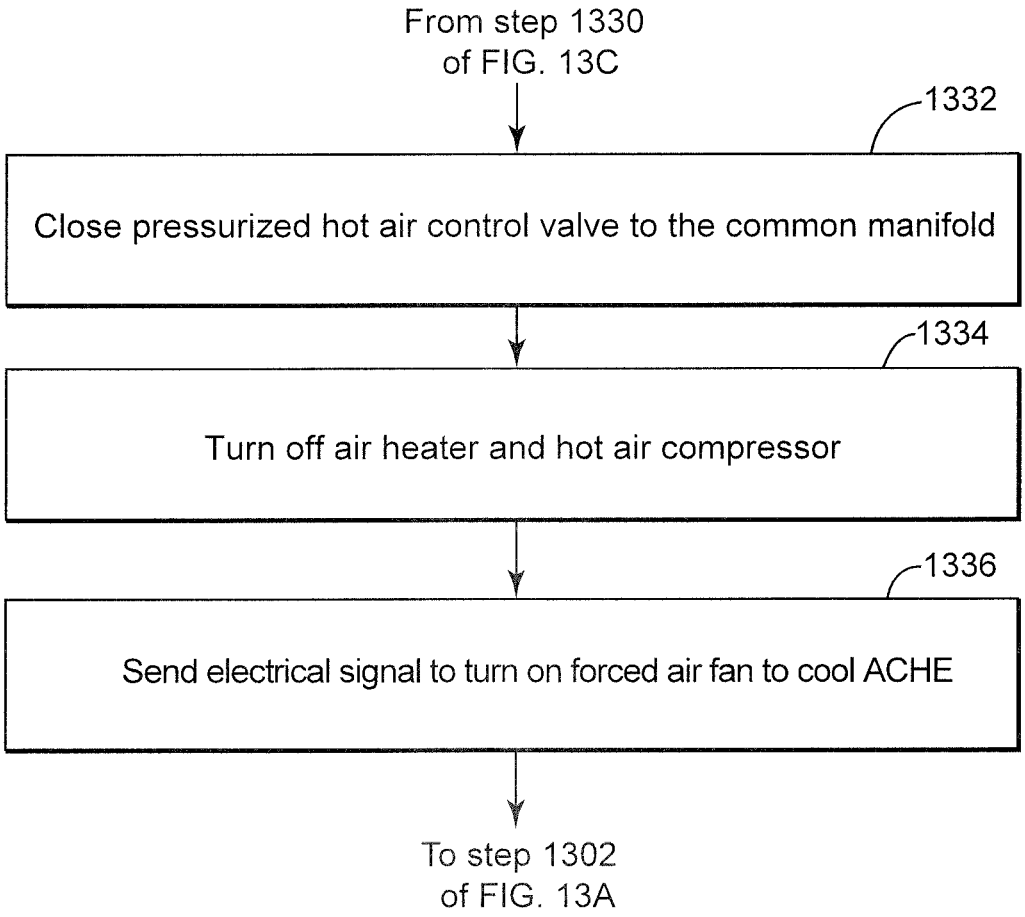

Referring now to FIGS. 12A-12C, a flow diagram illustrating an embodiment of a method 1200 for performing an automated cleaning cycle of the ACHE 1002 is illustratively shown. The method 1200 begins with step 1201 where the forced air fan unit 1010 is turned off, e.g., by the controller 1700, and proceeds to step 1202, where a controller 1700 is provided with predetermined acceptable temperature range values of cooled process liquid to be discharged through the outlet 1030 of the ACHE 1002. In one embodiment, the temperature range values are defined by inputting a predetermined low temperature value and a predetermined high temperature value into the memory 1720 of the controller 1700 via a keyboard or other user input device. A person of ordinary skill in the art will appreciate that the temperature range values are dependent in part on the environmental temperature conditions at the location in which the ACHE 1002 is operating. At step 1204, the controller 1700 monitors current temperature measurements from various designated cooling and heating sources including the ambient wash water source 201, cooled mixing water source 301, and the hot mixing water source 401. The method 1200 then proceeds to step 1206.

At step 1206, the controller 1700 determines if the wash water from the designated source 201 that is to be released to the ACHE 1002 is at a temperature that will maintain the process liquid within the predetermined acceptable range of step 1202. If, at step 1208, the measured wash water temperature from the designated source 201 is within the acceptable cooling temperature range, the method 1200 proceeds to step 1216 of FIG. 12B, where the ambient water source 202 is released into the water vessel 201 and a timed washing cycle is initiated, as described in further detail below. If, however, at step 1208, the measured wash water temperature from the designated source 201 is not within the acceptable cooling temperature range of step 1202, then the method 1200 proceeds to step 1210 of FIG. 12B.

At step 1210, the controller 1700 calculates a proportion of cool or hot mixing water required to respectively lower or raise the temperature of the ambient washing water 201 to properly maintain the process liquid within the predetermined acceptable cooled temperature range. At step 1212, the controller 1700 sends one or more control signals to actuate one or more control valves 220, 320, 420 to control a proportional flow of ambient wash water and cool or hot mixing water to the wash water vessel 201. If at step 1214, the temperature of washing water is not within the calculated temperature range, then the method 1200 loops back to steps 1210 and 1212 until such time that at step 1214, the temperature of the wash water in the vessel 200 is within the calculated cooling temperature range. The method then proceeds to step 1216 where the timed washing cycle is initiated. The duration of the timed washing cycle can be set based on the existing conditions and operational experience, and on a visual inspection of the ACHE.

Referring to FIG. 12C, at step 1218 if one or more cleaning additives 208 are to be employed with the wash water, the method 1200 proceeds to step 1220, where the controller 1700 sends a control signal to actuate a control valve 210 for releasing the cleaning additive(s) 208 into the wash water 201. Examples of suitable cleaning additives can include, but are not limited to FALCHEM air cooler cleaner from Falchem International, and UNITOR™ air cooler cleaner from Wilhelmsen Holding. Once the cleaning additive(s) are released into the wash water 201, at step 1222, the method 1200 initiates the wash cycle, which is timed by clock/timer 1050 and monitored by the controller 1700. If, however, cleaning additives 208 are not being released into the wash water 201, the method 1200 proceeds directly to the washing cycle at step 1222. During the cleaning cycle, the nozzles 122 of the spray tubes 120 spray the pressurized wash water onto the finned tubes 32 to cleanse and rinse away undesirable dirt and debris, and thereby enhance the reliability and operation of the ACHE 1002 to properly cool the process liquid for discharge at the discharge outlet 1030. At step 1224, the controller 1700 determines whether the timed wash cycle has been completed. If at step 1224 the timed wash cycle is not completed, the controller 1700 continues to monitor the cleaning operation of step 1222 (e.g., monitoring pressure and temperature measurements of the process liquid inlet, outlet and wash water mix) until such time that the wash cycle is complete. Once the timed washing cycle is complete at step 1226, the flow valve 220 is closed, the forced air fan unit 1010 is turned back on, e.g., by the controller 1700 and method 1200 ends at step 1299.

Referring now to FIGS. 13A-13D, a flow diagram illustrating a method 1300 of an automated operation for passing cooled or heated air onto the finned tubes 32 of the ACHE 1002 under extremes of ambient weather/temperature conditions. The method 1300 begins at step 1301 and proceeds to step 1302, where the controller 1700 continuously or periodically monitors the temperature of the process liquid being discharged from the ACHE 1002 at the cooled process liquid discharge outlet 1030 by receiving electronic signals from one or more pressure/temperature sensors 1032. At step 1304, if the controller 1700 determines that the measured temperature at the process liquid discharge outlet 1030 exceeds the high temperature value of the predetermined temperature range value stored in the memory 1720 of the controller 1700 (as discussed above with respect to step 1202 of FIG. 12A), the method 1300 proceeds to step 1306.

At step 1306, the controller 1700 sends an electronic control signal to turn off the forced air fan unit 1010 beneath the ACHE 1002, and activate the air cooler 340 and compressor 330 to deliver compressed cooled air having a predetermined operating pressure and temperature to the cooled air source 301 (e.g., an insulated air storage tank). If the automated cleaning routine 1200 of FIGS. 12A-12C is being run when an extreme cold or hot temperature reading of the process liquid is detected, the cleaning routine 1200 is terminated and the water flow valve 220 is closed to prevent any water from entering the common manifold 1100.

At step 1308, the controller 1700 sends an electronic signal to open the pressurized cooled air control valve 320 which admits cooled air to the common manifold 1100 via open master flow control valve 1102. The pressurized cooled air from the cooled air source 301 flows through the spray tube nozzles 122 in a direction to further cool the finned tubes 32 instead of the hot air previously being blown towards the ACHE 1002 by the forced air fan unit 1010. At step 1310, the controller 1700 continues to receive electrical signals from the temperature sensor 1032 to measure the temperature of the process liquid discharged at the cooled process liquid discharge outlet 1030 of the ACHE 1002. The method 1300 then proceeds to step 1312 of FIG. 13B.

If, at step 1312, the controller 1700 detects that the measured temperature is still above the predetermined temperature range, the method 1300 proceeds to step 1308, where the controller 1700 and air cooler 340 continue to direct cooled pressurized air at the finned tubes 32 via the spray tube nozzles 122. If, however, at step 1312 the measured temperature is no longer above the high value of the predetermined temperature range, the method 1300 proceeds to step 1314 and 1316, where the pressurized cooled air control valve 320 is closed to stop further cooled airflow to the manifold 1100, and the controller 1700 sends control signals to turn off the air cooler 340 and the compressor 330 (step 1316). At step 318, and the forced air fan 1010 is activated to either reduce or terminate the flow of cooled air to the ACHE 1002.

One of ordinary skill in the art will appreciate that the cooling operation by the cooled air system 300 can be set to turn off at a temperature value that is somewhat lower than the high temperature value set at step 1202 of FIG. 12A. This is preferable in order to prevent the air cooling unit 340 from repeatedly switching on and off when the process liquid temperature is on the cusp, i.e., at or near the high temperature value set at step 1202 of FIG. 12A. For example, if the low and high temperature values of step 1202 are set at twenty-four and thirty-seven degrees Celsius, the cooled air system 300 can be set to turn off once the process liquid reaches or preferably maintains a temperature below thirty-one degrees C. for a predetermined time, e.g., twenty minutes.

The controller 1700 continues to monitor the temperature at the process liquid discharge outlet 1030 and, at step 1320, if the measured temperature value at the discharge outlet 1030 is above the high temperature value of the predetermined temperature range for the process liquid temperature, the method 1300 returns to step 1306 to reactivate the cooling operation by the cooled air system 300. Otherwise, the method 1300 proceeds to step 1322 of FIG. 13C. At step 1322, if the controller 1700 detects that the measured temperature of the process liquid is within the low and high temperature values set at step 1202 of FIG. 12A, the forced air fan unit 1010 continues to operate at step 1318. If, however, the controller 1700 detects the temperature of the process liquid is below the low temperature value set at step 1202 of FIG. 12A, the method proceeds to step 1324. This can occur in desert environments where night time temperatures drop significantly and the forced air fan is turned off, but the ambient air still reduces the process liquid below the low temperature of the acceptable range.

At step 1324, the controller 1700 sends an electronic control signal to activate the air heater 440 and compressor 430 of the heated air system 400 to deliver compressed hot air having a predetermined operating pressure and temperature to the heated air source 401 (e.g., an insulated air storage tank). At step 1326, the controller 1700 sends an electronic signal to open the pressurized heated air control valve 420, which admits heated air to the common manifold 1100 via the open master flow control valve 1102. The pressurized heated air flows through the directional spray tube nozzles 122 to heat the finned tubes 32 of the ACHE 1002. At step 1328, the controller 1700 continues to receive electrical signals from the temperature sensor 1032 to measure the temperature of the process liquid discharged from the ACHE 1002 at the cooled process liquid discharge outlet 1030. The method 1300 then proceeds to step 1330.

At step 1330, if the controller 1700 detects that the measured temperature at the discharge outlet 1030 is still below the predetermined temperature range, the method 1300 loops back to step 1326, where the heated air system 400 continues to direct pressurized heated air at the finned tubes 32 via the spray tube nozzles 122. Optionally, the controller 1700 directs that the temperature and/or pressure of the air entering the heat exchanger be increased to expedite the heating of the process liquid. Once, at step 1330, the measured temperature at the discharge outlet 1030 exceeds the low temperature value of the predetermined temperature range, the method 1300 proceeds to steps 1332 and 1334, where the pressurized heated air control valve 420 is partially or fully closed to reduce or stop heated air from flowing into the manifold 1100 and out through the nozzles 122 and the air heater 400 and compressor 430 are turned off (step 1334). The method 1300 then proceeds to steps 1336, where the controller 1700 sends electronic control signals to turn on the forced air fan unit 1010 to maintain the normal cooling operation of the process liquid by the ACHE 1002.

One of ordinary skill in the art will appreciate that the heating operation by the heated air system 400 can be set to turn off at a temperature value that is somewhat higher than the low temperature value set at step 1202 of FIG. 12A. This is preferable in order to prevent the air heating unit 440 from repeatedly cycling on and off when the process liquid temperature is on the cusp, i.e., at or near the low temperature value set at step 1202 of FIG. 12A. For example, if the low and high temperature values of step 1202 are again illustratively set at twenty-four and thirty-seven degrees Celsius, the heated air system 400 can be set to turn off once the process liquid reaches or preferably maintains a temperature several degrees above the low end of the range for a predetermined time, e.g., based on operator experience.

While several embodiments of the invention have been described above and in the attached drawings, additional alternatives, modifications and variations will be apparent to those of ordinary skill in the art from this description, and the scope of the invention is therefore to be determined by the claims that follow.

The invention claimed is:

1. A method for cleaning and/or cooling or heating an air-cooled heat exchanger (ACHE) operating in extremes of ambient air temperatures to maintain a process fluid at or within a predetermined target temperature or temperature range, the ACHE including an array of finned air-cooled tubes extending in fluid communication between opposing headers, the plurality of finned tubes being arranged horizontally into a plurality of vertically spaced-apart rows, the fumed tubes thereby defining parallel open regions in the array, the method comprising:

a. permanently installing at a position proximate a header at one end of the ACHE a common manifold configured to receive and transmit a pressurized fluid from an external source, the common manifold extending above and transverse to the top row of finned tubes;

b. providing a plurality of spray tubes, each of the spray tubes extending parallel to, and substantially coterminous in length with the finned tubes, the ends of the spray tubes opposite the common manifold being sealed, one of each of the spray tubes being positioned in one of the open regions defined by the spaced-apart rows of finned tubes, the spray tubes being provided with spaced-apart nozzles for discharging a pressurized fluid to contact the adjacent surfaces of the fins and the tubes;

c. providing a plurality of intermediate fluid conduits extending between, and in fluid communication with the common manifold and the ends of each of the spray tubes proximate the header for delivering the pressurized fluid from the common manifold to the nozzles of each of the spray tubes to thereby provide an integrated array of spray tubes positioned in the ACHE;

d. providing a source of pressurized temperature-controlled water that is in controlled fluid communication with the common manifold;

e. monitoring the temperature of the process fluid at a location proximate a location of discharge of the process fluid from the ACHE, where the method is practiced subject to one or more of the following conditions:

a first condition being that the controlled operation of the ACHE cannot achieve and/or maintain the target temperature of the process fluid, and the method comprises initiating a cleaning of the air-cooled finned tubes to remove dirt and dust by introducing into the common manifold for discharge through the nozzles a pressurized cleaning fluid to remove the dirt and dust from the finned tubes;

a second condition being that the ambient air temperature is so high that it exceeds the ability of the ACHE to reduce the process fluid temperature to the target temperature, wherein the method comprises:

i. supplying a controlled flow of pressurized cooling water from an external source to the common manifold for discharge through the nozzles to reduce the temperature of the process fluid;

ii. if the monitored temperature of the process fluid remains higher than the target temperature after step (e)(i) above, then introducing compressed air from an external source into the manifold with the cooling water and discharging a mist of water droplets in compressed air from the nozzles to effect increased evaporative cooling of the air passing over the fins to cool the process liquid to the target temperature;

a third condition being that the ambient air temperature is so low that the ACHE is unable to maintain the process fluid temperature at the targeted temperature, wherein the method comprises:

iii. introducing a controlled flow of pressurized hot air from an external source into the common manifold for discharge from the nozzles to increase the temperature of the process fluid; and iv. if the monitored temperature of the process fluid remains lower than the target temperature after step (e)(iii) above, introducing a controlled flow of steam from an external source into the common manifold for discharge through the nozzles until the target temperature is achieved.

2. The method of claim 1 which further comprises controlling the speed and operation of one or more fans of the ACHE in response to changes in the ambient air temperature in order to achieve and/or maintain the process fluid target temperature.

3. The method of claim 1 where the cleaning fluid is selected from the group consisting of water, an aqueous solution of a detergent or chemical agent, and compressed air and particles of bicarbonate of soda, alone or with other abrasive particles, and combinations thereof.

4. The method of claim 3 in which the temperature of the cleaning fluid is controlled to cool the process fluid to the target temperature.

5. The method of claim 3 in which the cleaning fluid is water or an aqueous solution, and heated or cooled water from an external source is mixed with water at ambient temperature to provide the cleaning fluid at a temperature predetermined to effect the reduction in temperature of the process fluid to the target temperature when sprayed on the finned tubes.

6. The method of claim 3 in which one or more fans of the ACHE are turned off during the cleaning of the air-cooled finned tubes.

7. The method of claim 1 in which the temperature of the cooling water is controlled by mixing water cooled by a refrigeration apparatus at ambient temperature.

8. The method of claim 1 in which the temperature and/or flow rate of the cooling water sprayed through the nozzles in step (e)(i) is controlled to maintain the target temperature of the process fluid.

9. The method of claim 1 in which the temperature and/or flow rate of the hot air or steam sprayed through the nozzles in steps (e)(iii) or (e)(iv) is controlled to maintain the target temperature of the process fluid.

* * * * *